US009081332B2

(12) United States Patent
Suzuki

(10) Patent No.: US 9,081,332 B2
(45) Date of Patent: Jul. 14, 2015

(54) IMAGE FORMING SYSTEM FOR TRANSFERRING A FOIL IMAGE

(71) Applicant: Konica Minolta, Inc., Tokyo (JP)

(72) Inventor: Tomoo Suzuki, Tokyo (JP)

(73) Assignee: KONICA MINOLTA, INC. (JP)

( * ) Notice: Subject to any disclaimer, the term of this patent is extended or adjusted under 35 U.S.C. 154(b) by 85 days.

(21) Appl. No.: 13/893,863

(22) Filed: May 14, 2013

(65) Prior Publication Data

US 2013/0308992 A1 Nov. 21, 2013

(30) Foreign Application Priority Data

| | | |
|---|---|---|
| May 17, 2012 | (JP) | 2012-113530 |
| Jun. 25, 2012 | (JP) | 2012-142051 |
| Mar. 27, 2013 | (JP) | 2013-067454 |
| Mar. 27, 2013 | (JP) | 2013-067455 |

(51) Int. Cl.

| | |
|---|---|
| ***G03G 15/20*** | (2006.01) |
| ***G03G 15/16*** | (2006.01) |
| ***G03G 15/22*** | (2006.01) |
| ***G03G 21/04*** | (2006.01) |

(52) U.S. Cl.

CPC ..... *G03G 15/16* (2013.01); *G03G 15/225* (2013.01); *G03G 21/04* (2013.01)

(58) Field of Classification Search

USPC ..... 283/72; 399/297, 341, 342

See application file for complete search history.

(56) References Cited

U.S. PATENT DOCUMENTS

| | | | | |
|---|---|---|---|---|
| 2006/0145467 | A1* | 7/2006 | Burchard | 283/72 |
| 2010/0104336 | A1* | 4/2010 | Christopher et al. | 399/341 |

FOREIGN PATENT DOCUMENTS

| | | | |
|---|---|---|---|
| JP | 62-255184 | A | 11/1987 |
| JP | 63-286399 | A | 11/1988 |

* cited by examiner

*Primary Examiner* — Hoang Ngo

(74) *Attorney, Agent, or Firm* — Cantor Colburn LLP

(57) ABSTRACT

An image forming apparatus transfers a negative toner image on a waste sheet of paper having larger size than that of a printing sheet of paper and transfers all the toner images on the printing sheet of paper. A first thermal transferring portion transfers an unnecessary foil of a foil sheet on the negative toner image of the waste sheet of paper image. A second thermal transferring portion transfers a foil remained on the foil sheet on the positive toner image of the printing sheet of paper. The positive toner image is formed using transparent toner. Any gradation processing is performed on an edge of the positive toner image.

11 Claims, 19 Drawing Sheets

500 (504)
504
502
500
Pn
510
512

500
510
512
Pn
502
504
500
Pn
512
510
512

500
(504)
504a
504b
504b
504a
504b

Pn
510
504c
504c
510
504c
512
Pn 500 (504)
504b
504a
504
502
500
504b
504a
504b
Pp
522
520
526
528
524
Star Beer
522
520
524
Pp
522
524

500
504a
(520)
504b
(524)
Star Beer
Pp
500
502
504
500
Pp
524
520
504a
524
504b 500 (504)
504b
504
502
500
504b Pp
522
504a (520)
526
524
528
Star Beer
Pp
524
504a
520
524

500 (504)
504
502
500
Pn
510
512
512
510
512
Pn 500
510
512
Pn
502
504
500
Pn
512
510
512

500
(504)
504a
504b
504b
504a
504b

Pn
510
504c
504c
510
504c
512
Pn 500 (504)
504b 504a
504b
504
502
500
504a
504b
Pp
522
520
526
528
524
Star Beer
524
Pp
520

500
504a (520)
504b (524)
Star Beer
Pp
502
504
500
524
Pp
504a
520
524

500(504)
504b
504
502
500
504b

Pp
522
520
526
528
524
Star Beer
524
Pp
504a
520
524

IMAGE FORMING SYSTEM FOR TRANSFERRING A FOIL IMAGE

CROSS REFERENCE TO RELATED APPLICATION

The present invention contains subject matters related to Japanese Patent Application Nos. JP 2012-113530, JP2013-67454, JP2012-142051 and JP2013-67455 filed in the Japanese Patent Office on May 17, 2012, Jun. 25, 2012 and Mar. 27, 2013, the entire contents of which being incorporated herein by reference.

BACKGROUND OF THE INVENTION

1. Field of the Invention

The present invention relates to an image forming system, in which a desired foil image is transferred on a desired toner image on base material on which an image has been formed.

2. Description of Related Art

In a bookbinding field, a commercial printing field, a card business field or a plastic molding field such as cosmetic container, printing has been performed such that a character and/or a picture image made of foil are transferred to the sheet of paper in order to give metallic appearance or a high-quality glossy image to a product, which cannot be expressed merely by common printing. In recent years, foil transferring technology has been utilized for anti-counterfeiting a cash card or a credit card and for a hologram provided for a security.

As the foil transferring technology, for example, Japanese Patent Application Publication No. S62-255184 discloses a thermal transfer printing apparatus in which a foil sheet having a foil layer on a film base member is placed on base material having a toner image for electrostatic copying while the foil layer overlaps the toner image to each other and by applying any pressure on them from above and heating them, the foil layer is transferred to the toner image.

Further, Japanese Patent Application Publication No. S63-286399 discloses a foil image forming method for forming the foil image. In this method, a toner image is formed on a sheet, a color foil is applied thereto using a thermo compression bonding, and a foil image is transferred to supporting medium using the color foil in which a color layer of the contacting portion thereof with the toner image is removed from a foil main body. Namely, in this foil image forming method, an foil image is formed by the following steps of: (1) A negative image in which an original image is reversed is copied to form a negative image copy; (2) Plastic foil for foil-stamping is stamped to the negative image copy using a thermo compression bonding; (3) By then removing them from each other, a color layer of a toner contacting portion is adhered onto the negative image copy and remained thereon; (4) A positive image of the original image is thus formed on the plastic foil for foil-stamping; and (5) The positive image of the original image is stamped to supporting medium such as polyvinyl chloride sheet using a thermo transfer printing.

SUMMARY OF THE INVENTION

In a foil transferring method of the thermal transfer printing apparatus disclosed in Japanese Patent Application Publication No. S62-255184, however, when any toner image(s) other than the above-mentioned desired toner image on which the foil image is to be transferred is (are) formed on the base material, the toner images may be thermally fused to have a fusion function to adhere to the foil images to be transferred, so that the foil images may be not only transferred to a desired toner image for adhering to the target foil image but also other toner image(s) which has (have) already formed on the base material, for example, toner image such as a design image. In other words, the foil images may be transferred to all the toner images formed on the base material. As a result thereof, it is difficult to provide an image forming system in which only a desired target foil image is transferred.

Further, in the foil transferring method of the foil image forming method of Japanese Patent Application Publication No. S63-286399, a sheet of paper on which a positive image or a negative image is printed is prepared and plural operation steps of stamping the foil to the sheet of paper using the thermo compression bonding are performed by hand or using apparatuses separately. It is difficult to perform the foil printing automatically using successive steps. Further, since it is difficult to perform the foil printing steps successively, the productivity thereof may be deteriorated.

Further, in the past foil transferring method, when the foil image of the foil sheet is not aligned with the positive toner image having high accuracy, it is difficult to attain any desired foil processed image. When such an alignment is performed by human power, it is difficult to do the alignment with high accuracy. When the alignment is complete, it takes a long time. Thus, it is difficult to perform the foil printing with high accuracy.

Particularly, as shown in FIGS. 1A and 1B, when the desired positive toner image 620 and other toner image such as designs 624 are formed on the sheet of paper Pp and the sheet of paper Pp is shifted toward an arrow direction shown in FIG. 1A at the time of putting the foil sheet 600 onto the sheet of paper Pp, an edge portion 604*d* of the foil layer 604 may be put on the designs 624 of the sheet of paper Pp. In this case, based on the fusion function of the toner image of the design 624, as shown in FIG. 1B, the unnecessary edge portion 604*d* of the foil layer 604 may be transferred to the designs 624. Further, when there is a little difference in sizes of the sheets of paper, an edge portion 604*d* of the foil sheet 600 may be transferred to the designs 624. This causes unintended edge portion 604*d* of the foil other than the target foil image 604*a* to be transferred, which avoids performing the foil transfer with high quality and high accuracy.

This invention addresses the above-mentioned issues and has an object to provide an improved image forming system which performs foil transfer processing on a sheet of paper on which a toner image such as a design other than a desired toner image is formed, under automatic successive steps.

This invention also has another object to provide another improved image forming system which performs foil transfer processing under automatic successive steps even when the sheet of paper or the desired positive toner image fails to align one with the other.

To achieve the above-mentioned objects, an image forming system reflecting one aspect of the present invention, which forms a desired positive foil image on a desired positive toner image of second base material, contains an image forming portion which forms, on a first base material, a desired negative toner image that reverses positive image in order to transfer foil thereon and forms, on the second base material, all the toner images, the toner images including the desired positive toner image in which the positive image is enlarged. The image forming system further contains a paper-feeding portion that feeds the first and second base materials to the image forming portion, the paper-feeding portion being positioned at an upstream side of the image forming portion, a conveying portion which conveys a foil sheet having a foil layer on its surface, the conveying portion being positioned at a downstream side of the image forming portion, a first transferring portion which transfers the desired negative foil image from the foil sheet on the desired negative toner image of the first base material, the first transferring portion being positioned at an upstream side of the conveying portion, a second transferring portion which transfers the desired positive foil image on the desired positive toner image of the second base material, the second transferring portion being positioned at a downstream side of the first transferring portion on the conveying portion, the desired positive foil image being formed on the foil sheet by transferring the desired negative foil image on the first base material in the first transferring portion and removing the desired negative foil image from the foil sheet, and a control portion which controls at least the image forming portion, wherein the control portion controls the image forming portion to form the desired positive toner image, which is enlarged more than the desired positive foil image, on the second base material.

To achieve the above-mentioned objects, an image forming system reflecting another aspect of the present invention, which forms a desired positive foil image on a desired positive toner image of second base material, contains an image forming portion which forms, on a first base material, a desired negative toner image that reverses positive image for transferring foil and forms, on the second base material, all the toner images, the toner images including the desired positive toner image in which the positive image is enlarged. The image forming system also contains a paper-feeding portion that feeds the first and second base materials to the image forming portion, the paper-feeding portion being positioned at an upstream side of the image forming portion, a conveying portion which conveys a foil sheet having a foil layer on its surface, the conveying portion being positioned at a downstream side of the image forming portion, a first transferring portion which transfers the desired negative foil image from the foil sheet on the desired negative toner image of the first base material, the first transferring portion being positioned at an upstream side of the conveying portion, a second transferring portion which transfers the desired positive foil image on the desired positive toner image of the second base material, the second transferring portion being positioned at a downstream side of the first transferring portion on the conveying portion, the desired positive foil image being formed on the foil sheet by transferring the desired negative foil image on the first base material in the first transferring portion and removing the desired negative foil image from the foil sheet, and a control portion which controls at least the image forming portion. In this image forming system, the control portion controls the image forming portion to form the desired positive toner image on the second base material, the desired positive toner image being enlarged from the desired positive foil image.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing (s) wherein like reference characters refer to like elements.

DESCRIPTION OF THE PREFERRED EMBODIMENTS

The following will describe preferred embodiments relating to the invention with reference to drawings. It is to be noted that the description in the embodiments is exemplified and any technical scope of the claims and/or meaning of term(s) claimed in the claims are not limited thereto.

First Embodiment

Configuration Example of Image Forming System

Figure 1A:
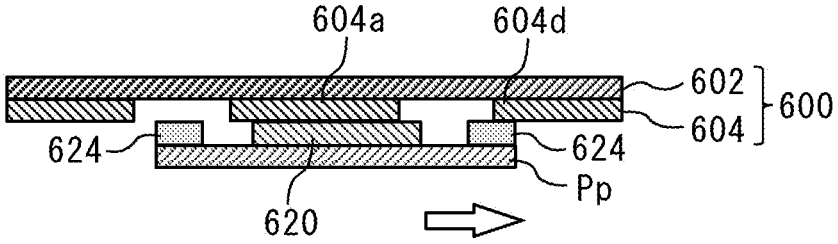
RELATED ART FIG.1A
FIGS. 1A and 1B are diagram for illustrating issues of the past foil transferring method.
Figure 1B:
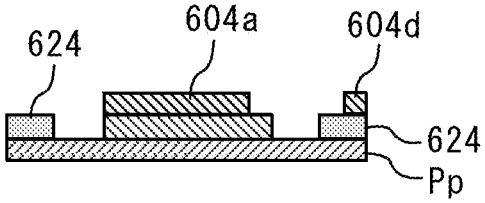
Figure 2:
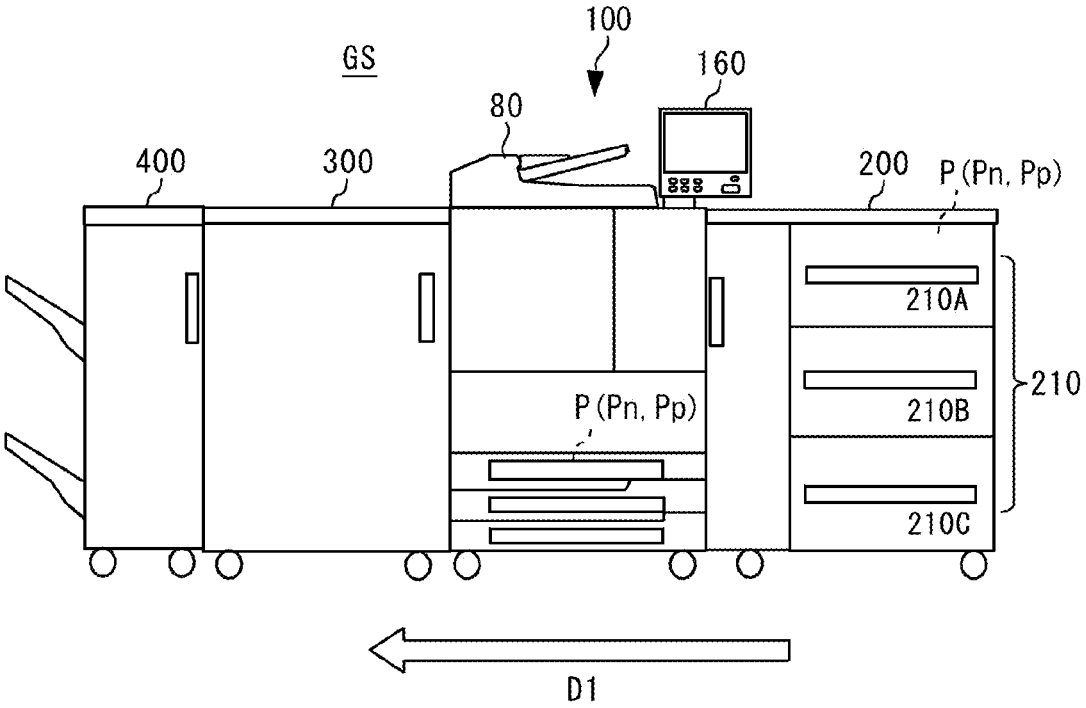
FIG. 2 is a diagram of an image forming system according to a first embodiment of this invention showing a configuration example thereof.

The following will describe a first embodiment of an image forming system GS relating to the invention with reference to drawings. FIG. 2 shows a configuration example of the image forming system GS. It is to be noted that a size and a ratio in each of the drawings are exaggerated reduced for convenience of explanation and the ratio or the like may be different from the actual one. As shown in FIG. 2, the image forming system GS according to the invention is provided with a large capacity feeder 200, an image forming apparatus 100, a foil transferring apparatus 300 and a finisher 400. In FIG. 2, a sign, "D1" indicates a sheet-conveying direction.

The large capacity feeder 200 connects the image forming apparatus 100 at an upstream side along the sheet-conveying direction D1 of a sheet of paper P. The large capacity feeder 200 contains plural feeding trays 210 which contain a large quantity of sheets of paper P. The feeding trays 210 are universal trays which is configured so that the sheets of paper P having optional sizes can be set. In this embodiment, the sheet of paper Pp as second base material and the waste sheet of paper Pn as first base material which has a larger size than that of the sheet of paper Pp are set in the feeding trays 210. The waste sheet of paper Pn used as the first base material is a waste sheet on which a desired negative foil image is transferred and which is wasted. The sheet of paper Pp used as the second base material is base material on which all the toner images are formed and then, a desired positive foil image is transferred. Any foil transfer processing is performed on the sheet of paper Pp so that the sheet of paper Pp becomes a printed sheet. The large capacity feeder 200 feeds the sheets of paper P one by one from a feeding trays 210 which contains user specified sheets of paper while they are separated by a fan, an absorption conveying portion and the like. The large capacity feeder 200 conveys the fed sheet of paper P to the image forming apparatus 100 through the conveying rollers or the like. It is to be noted that although one feeder 200 has been used in this embodiment, the invention is not limited thereto: more than one large capacity feeder 200 may be connected.

The image forming apparatus 100 transfers a desired negative toner image on the waste sheet of paper Pn that is fed from the large capacity feeder 200 or a feeding portion 20 (see FIG. 3) in the image forming apparatus 100 during the foil transfer processing. The desired negative toner image, which reverses the desired positive foil image, is adhered on the desired negative foil image so that the desired negative foil image can be removed therefrom. The image forming apparatus 100 also conveys the waste sheet of paper Pn to the following foil transferring apparatus 300. The image forming apparatus 100 further transfers all the toner images to the waste sheet of paper Pn that is fed from the feeder 200 or the like and conveys the waste sheet of paper Pn to the following foil transferring apparatus 300.

The image forming apparatus 100 is also provided with a manipulation/display portion 160 for allowing a user to set various kinds of conditions about foil transfer processing. The manipulation/display portion 160 is positioned on a case body of the image forming apparatus. The manipulation/display portion 160 includes a touch panel composed of, for example, liquid crystal display (LCD) and hard keys positioned on a periphery of the touch panel such as numeral buttons and a printing start button and the like. The manipulation/display portion 160 allows a user to select a foil transfer processing mode as the conditions about the foil transfer processing. The manipulation/display portion 160 also allows a user to select the area to be foil-transferred among image data received from an image reading portion 90, which will be described later, and the like. The user can do such a selection using various kinds of methods by a computer, not shown, or the like connected to the image forming apparatus 100.

The foil transferring apparatus 300 connects the image forming apparatus 100 at a downstream side along the sheet-conveying direction D1 of the sheet of paper P. The foil transferring apparatus 300 heats and presses a foil sheet on the waste sheet of paper Pn, on which the desired negative toner image is transferred, conveyed from the image forming apparatus 100 to transfer the desired negative foil image on the waste sheet of paper Pn. After the foil transferring apparatus 300 has finished to transfer the desired negative toner image, the foil transferring apparatus 300 heats and presses the foil sheet on the sheet of paper Pp, on which all the toner images including the desired positive toner image are transferred, conveyed from the image forming apparatus 100 to transfer the desired positive foil image which is remained in the foil sheet. The sheet of paper Pp, on which the desired positive foil image is transferred, and the waste sheet of paper Pn, on which the desired negative foil image is transferred, are conveyed to the following finisher 400. The waste sheet of paper Pn is ejected from the foil transferring apparatus 300*s* waste paper.

The finisher 400 connects the foil transferring apparatus 300*t* a downstream side along the sheet-conveying direction D1 of the sheet of paper P. The finisher 400 performs any finisher processing such as stable-binding processing, folding processing, Z-folding processing, and booklet trimming on the sheet of paper P fed from the foil transferring apparatus 300. The finisher 400 ejects and the waste sheet of paper Pn and the sheet of paper Pp, on which the foil transferring apparatus 300 performs the foil transfer processing, to paper-ejection trays.

[Configuration Example of Image Forming Apparatus]

Figure 3:
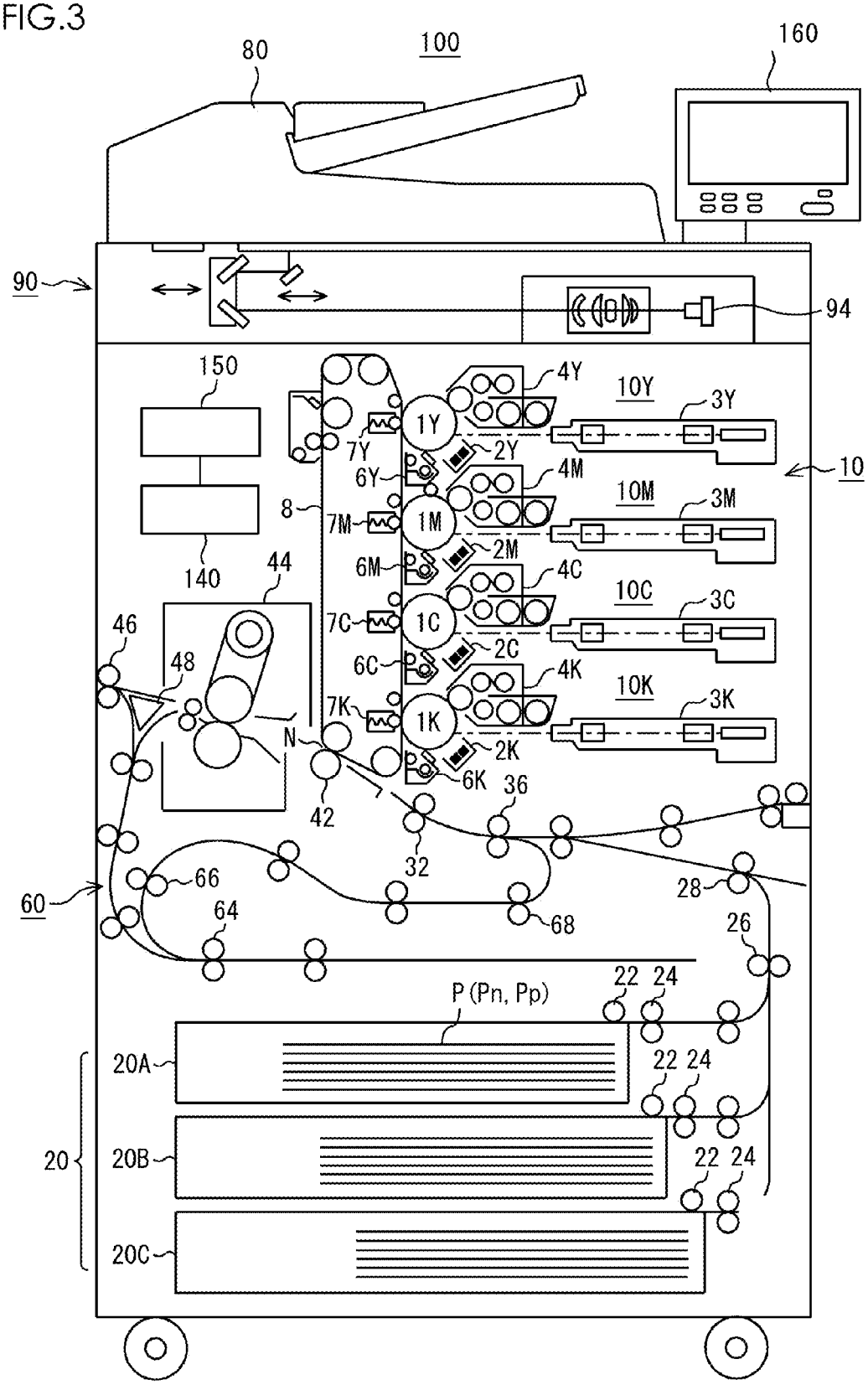
FIG. 3 is a diagram of an image forming apparatus showing a configuration example thereof.

The following will describe a configuration example of the image forming apparatus 100. FIG. 3 shows the configuration example of the image forming apparatus 100 according to this invention. As shown in FIG. 3, the image forming apparatus 100 is an image forming apparatus of tandem type. The image forming apparatus 100 contains a control portion 150, an image processing portion 140, the manipulation/display portion 160, an automatic document feeding portion 80, the image reading portion 90, an image forming portion 10, a fixing portion 44 and the feeding portion 20.

The control portion 150 has, for example, a central processing unit (CPU). The control portion 150 controls operations of respective portions of the image forming apparatus 100, and controls a control portion 350 (see FIG. 8) of the foil transferring apparatus 300 connecting the image forming apparatus 100 to perform the transfer processing of the foil image together with the foil transferring apparatus 300. The control portion 150 also controls a control portion 250 of the large capacity feeder 200 connecting the image forming apparatus 100.

The image reading portion 90 irradiates light onto the documents or the like conveyed from the automatic document feeding portion 80 one by one and receives reflected light using a charge-couple device (CCD) image sensor 94 to obtain image data D of the document. The image processing portion 140 performs various kinds of processing such as analog processing, analog/digital (A/D) conversion, compression and the like on the image data D obtained by the image reading portion 90.

The manipulation/display portion 160 displays a selection screen for setting of a species of the sheet of paper P to be used as base material and for selecting setting of image data Dp of foil processing area on which the foil is transferred among all the items of image data. The manipulation/display portion 160 also allows the user to select the species of the sheet of paper P and select the foil processing area. It is to be noted that the manipulation/display portion 160 may be installed in the foil transferring apparatus 300 method how to set the foil processing area among all the items of image data is performed by using any setting of an attribute of the image data D such as character, representation, graphic and the like, using any setting based on the selection of the foil processing area by inputting coordinates or the like.

Figure 8:
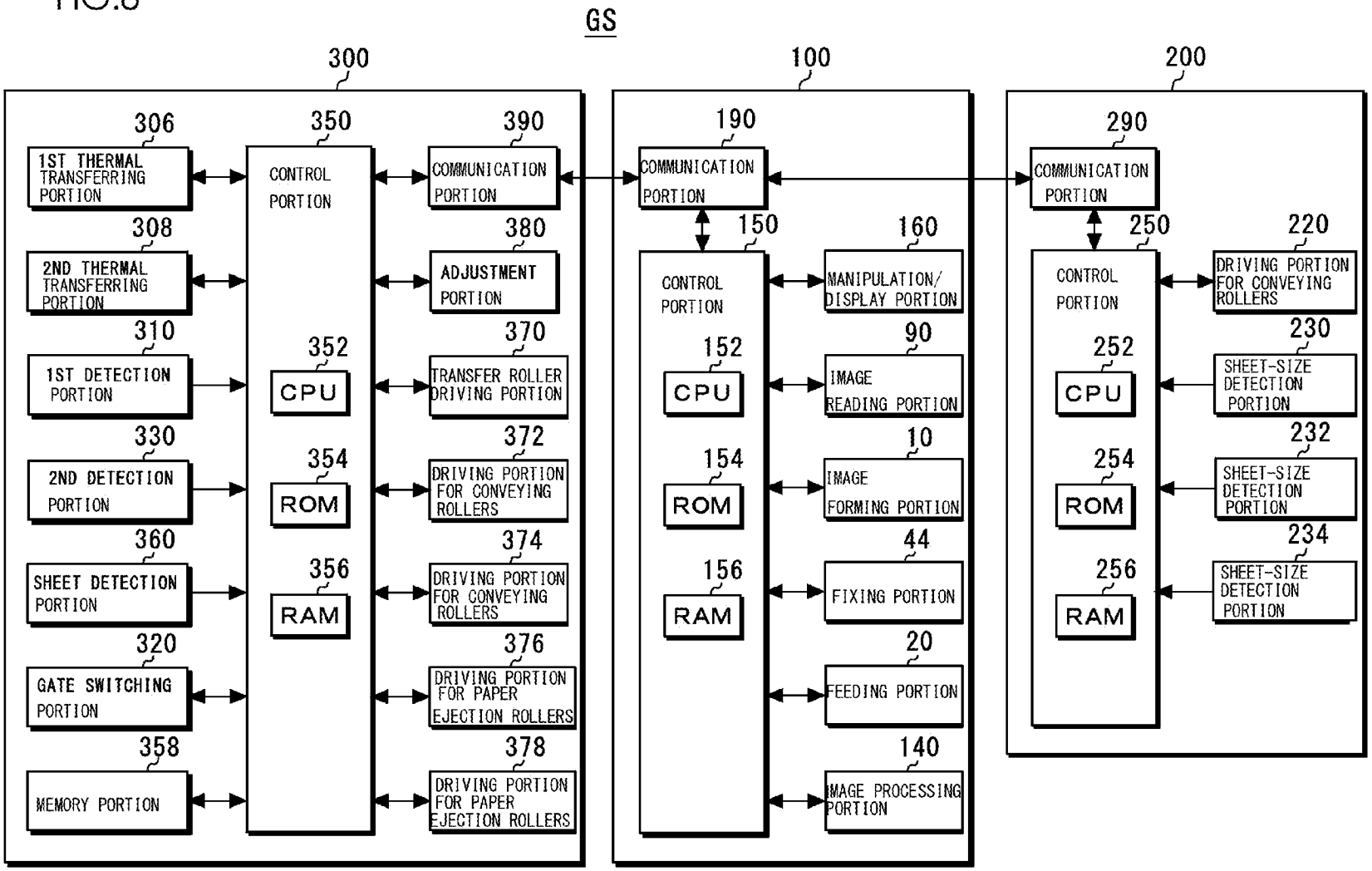
FIG. 8 is a block diagram of the image forming system showing a configuration example thereof.

The image processing portion 140 forms desired negative image data Dn and outputs the desired negative image data Dn to the foil transferring apparatus 300 (see FIG. 8). The desired negative image data Dn is data, which reverses desired positive image data Dp, corresponding to the selected foil processing area among items of image data D, in which any blank data is added to its edges so that the image data size corresponds to a size of first base material.

The image forming portion 10 forms an image under an electrophotographic system. The image forming portion 10 includes an image forming unit 10Y which forms a yellow (Y) image, an image forming unit 10M which forms a magenta (M) image, an image forming unit 10C which forms a cyan (C) image and an image forming unit 10K which forms a black (K) image. The image forming portion 10 also includes an intermediate transfer belt 8 charging toner images formed by the image forming units 10Y, 10M, 10C and 10K and secondary transfer rollers 42 forming a secondary transfer portion N for transferring the toner images on the intermediate transfer belt 8 on the sheet of paper P.

The image forming unit 10Y contains a photosensitive drum 1Y, a charging portion 2Y positioned around the photosensitive drum 1Y, an exposing (writing) portion 3Y, a developing portion 4Y and a cleaning portion 6Y. The photosensitive drums 1Y, 1M, 1C and 1K, the charging portions 2Y, 2M, 2C and 2K, the exposing portions 3Y, 3M, 3C and 3K, the developing portions 4Y, 4M, 4C and 4K, and the cleaning portions 6Y, 6M, 6C and 6K in the image forming units 10Y, 10M, 10C and 10K respectively have the common configuration to each other. The following will describe them with omitting the detailed explanation of the image forming units 10M, 10C and 10K and indicate them without attaching Y, M, C, K thereto apart from cases in which any differentiation is required.

The charging portions 2 charge a static charge almost uniformly around surfaces of the photosensitive drums 1. Each of the exposing portions 3 is composed of, for example, an LED print head (LPH) including LED array and focusing lens or a laser scan and exposure unit of polygon mirror system. The exposing portions 3 scan surfaces of the photosensitive drums 1 using laser beam based on the image data to form electrostatic latent images. The developing portions 4 develop the electrostatic latent images formed on the surfaces of the photosensitive drums 1 by using the toners. Accordingly, visible toner images are formed on the photosensitive drums 1.

The intermediate transfer belt 8 is stretched across plural rollers so as to be able to run around them. When driving primary transfer rollers 7Y, the intermediate transfer belt 8 runs and the toner images of each color formed on the respective photosensitive drums 1 are transferred onto their image transfer positions of the intermediate transfer belt 8 (primary transfer).

In this embodiment, when specifying a desired foil processing area on which the foil image is transferred, to be printed, by the manipulation/display portion 160, a computer, not shown, or the like, the desired negative toner images which reverse the image data Dp of the foil processing area to be printed are formed on the respective photosensitive drums 1. Next, all the toner images including the desired positive toner image on which the desired positive foil image is transferred and other toner images such as characters or designs are formed on the respective photosensitive drums 1.

The feeding portion 20 includes plural feeding trays 20A, 20B and 20C each containing sheets of paper with various kinds of sheet sizes such as A3 and A4. Each of the feeding trays 20A, 20B and 20C is provided with pick-up rollers 22 for feeding the sheet of paper P from each feeding tray and handling rollers 24 for preventing a multiple of sheets of paper from being sent from each feeding tray.

The feeding portion 20 feeds the sheet of paper P from the feeding tray selected on the manipulation/display portion 160 or the like using the pick-up rollers 22 and the like and conveys the fed sheet of paper P to registration rollers 32 via the conveying rollers 26, 28, 36 and the like.

The registration rollers 32 correct a deflection of the sheet of paper P thus conveyed by hitting a forward end of the sheet of paper P thereto by loop-forming rollers 36 (registration correction). When finishing the registration correction, the sheet of paper P is conveyed to the secondary transfer rollers 42 of the secondary transfer portion N at a predetermined timing. In the secondary transfer portion N, color toner images transferred on predetermined positions of the intermediate transfer belt 8 are secondarily transferred on a surface of the sheet of paper P collectively. In this embodiment, the desired negative toner image for transferring the desired negative foil image, to be not printed, and removing desired negative foil image from the foil sheet is transferred on the waste sheet of paper Pn fed from the feeding portion 20 or the large capacity feeder 200. Further, all the toner images including the desired positive toner image corresponding to the desired positive foil image, to be printed are transferred on the sheet of paper Pp fed from the feeding portion 20 or the like. The sheet of paper P which has been secondarily transferred is conveyed to the fixing portion 44.

The fixing portion 44 is provided at downstream side of the secondary transfer portion N along the sheet-conveying direction of the sheet of paper P. The fixing portion 44 contains a pressure roller, a heating roller and the like. The fixing portion 44 fixes the toner image on the surface of the sheet of paper P by applying pressure to the sheet of paper P onto which the secondary transfer portion N has transferred the toner image and/or heating the same.

A route changing portion 48 for changing the conveying rote of the sheet of paper P to a side of paper ejection route or a side of a reverse conveying path is provided at downstream side of the fixing portion 44 along the sheet-conveying direction of the sheet of paper P. The route changing portion 48 changes the conveying route based on the selected printing mode (a single-side printing mode or a duplex printing mode).

The sheet of paper P which is printed during the single-side printing mode or the sheet of paper P, or both surfaces of which are printed during the duplex printing mode is conveyed to the foil transferring apparatus 300 by sheet ejection rollers 46 after the sheet of paper P has been fixed in the fixing portion 44.

On the other hand, when the sheet of paper P is reversed during the duplex printing mode, the sheet of paper P, on a front surface of which the image has been formed, is conveyed to a reverse conveying path 60 via the route changing portion 48. The sheet of paper P conveyed to the reverse route 60 is conveyed to a switchback route under an inverse rotation control of ADU rollers 64 with a rear end thereof facing ahead thereof. The sheet of paper P is again fed to the image forming portion 10 through the conveying rollers 66, 68 and the like. On a back surface of the sheet of paper P again conveyed to the image forming portion 10, the desired toner image is formed in the secondary transfer portion N like the image forming process of front side of the sheet of paper P. In this embodiment, when the desired negative toner images are transferred on both surfaces of the waste sheet of paper Pn, the desired negative toner image is transferred on the back surface of the sheet of paper P by reversing the waste sheet of paper Pn. The sheet of paper P, on the back surface of which the desired negative toner image has been transferred by the image forming portion 10, is conveyed to the foil transferring apparatus 300 through the paper ejection rollers 46 and the like after the fixing portion 44 fixes the sheet of paper P.

[Configuration Example of Waste Sheet of Paper Pn as First Base Material]

Figure 4A:
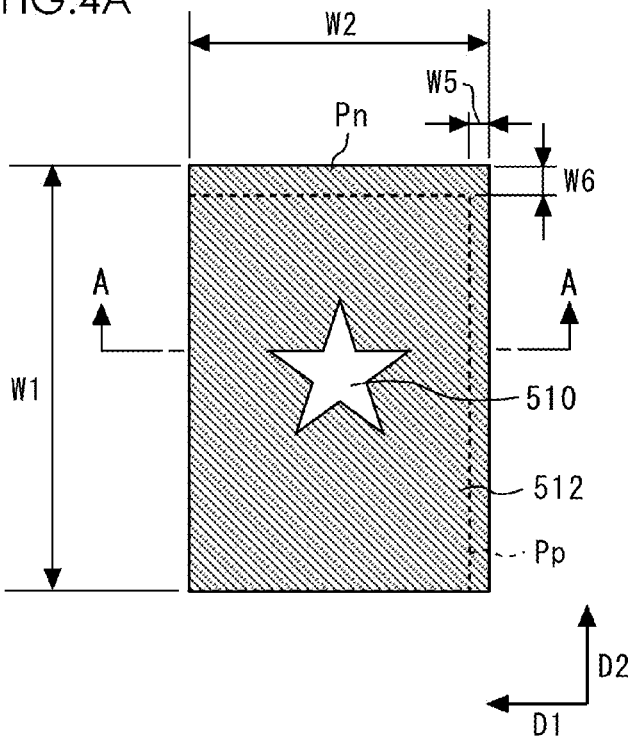
FIG. 4A is an illustration of a waste sheet of paper Pn and FIG. 4B is a sectional view thereof, taken along lines A-A.
Figure 4B:
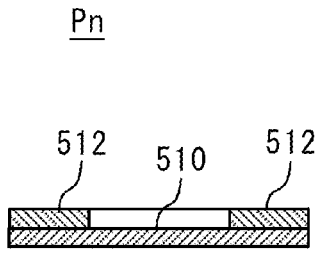

The following will describe the waste sheet of paper Pn on which the desired negative toner image on which the desired negative foil image, to be not printed, is transferred is transferred by the image forming apparatus 100. FIG. 4A shows the waste sheet of paper Pn on which the desired negative toner image 512 is transferred. FIG. 4B is a sectional view thereof, taken along lines A-A. It is to be noted that in the following description, a case where the desired positive foil image to be transferred to the sheet of paper Pp is a star image will be described.

As shown in FIGS. 4A and 4B, in the waste sheet of paper Pn, the desired negative toner image 512 is transferred on an area thereof corresponding to the desired negative foil image excluding the star image that is transferred to the waste sheet of paper Pn. The desired negative toner image 512 is a toner image for removing unnecessary foil image from the foil sheet 500 excluding the star image of the desired foil image. On the other hand, an area of the waste sheet of paper Pn on which the desired positive foil image having the star image is transferred becomes a recessed portion 510 from which the star image is removed. The recessed portion 510 has the same size as that of the desired positive foil image.

[Configuration Example of Sheet of Paper Pp as Second Base Material]

Figure 5A:
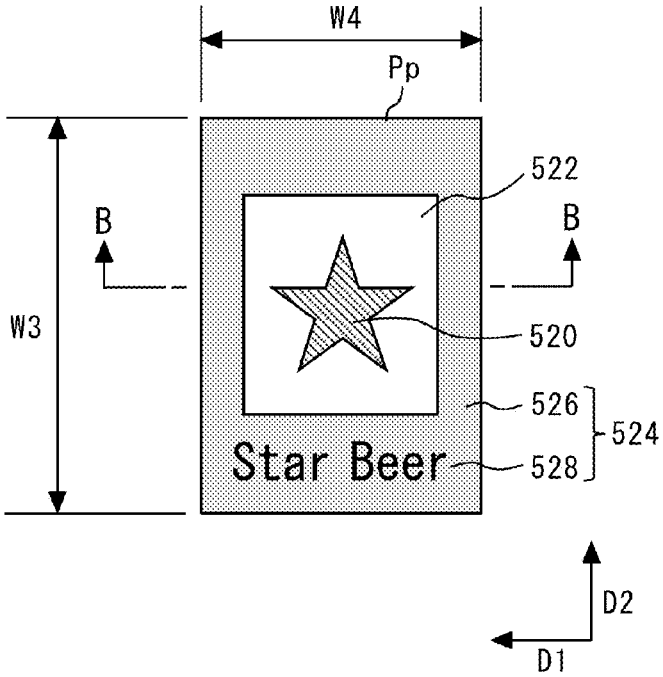
FIG. 5A is an illustration of a sheet of paper Pp and FIG. 5B is a sectional view thereof, taken along lines B-B.
Figure 5B:
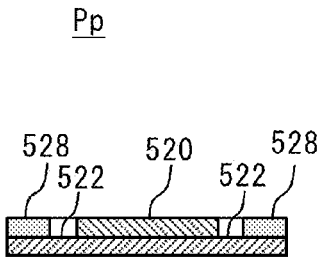

The following will describe the sheet of paper Pp on which the desired positive foil image, to be printed, is transferred. FIG. 5A shows the sheet of paper Pp on which the desired positive toner image 520 is transferred. FIG. 5B is a sectional view thereof, taken along lines B-B. It is to be noted that in the following description, a case where the desired positive foil image to be transferred to the sheet of paper Pp is a star image will be described.

As shown in FIGS. 5A and 5B, in the sheet of paper Pp, the desired positive toner image 520 of star image for transferring the desired positive foil image of star image is transferred to a middle area of the sheet of paper Pp. The desired positive toner image 520 is formed so as to have the same size as that of the desired positive foil image. Further, on each edge area along each side of the sheet of paper Pp, a design 524 is transferred surrounding the desired positive toner image 520 of the star image. In this embodiment, the design 524 includes a frame image 526 and a character image 528, "Star Beer". An area formed between the desired positive toner image 520 and the design 524 is a recessed portion 522 on which any toner image is not transferred.

[Size Comparison Example of Waste Sheet of Paper Pn as First Base Material and Sheet of Paper Pp as Second Base Material]

The following will describe a size comparison example of the waste sheet of paper Pn and the sheet of paper Pp. As shown in FIGS. 4A and 5A, the waste sheet of paper Pn has a width W2 along a sheet-conveying direction D1 thereof, which is longer than a width W4 of the sheet of paper Pp along the sheet-conveying direction D1 by a width W5. The waste sheet of paper Pn has a length W1 along a direction D2 that is perpendicular to the sheet-conveying direction D1, which is longer than a length W3 of the sheet of paper Pp along the direction D2 by a length W6. Thus, the waste sheet of paper Pn has a larger size than that of the sheet of paper Pp.

Specifically, when a sheet of paper of SRA4 size (W1(320 mm) length by W2(225 mm) width) is used as the waste sheet of paper Pn, a sheet of paper of A4 size (W3(297 mm) length by W4(210 mm) width) is used as the sheet of paper Pp which has a little smaller size than SRA4 size. When a sheet of paper of 12-by-18 inch size (W1 (457.2 mm) length by W2 (304.8 mm) width) is used as the waste sheet of paper Pn, a sheet of paper of 11-by-17 inch size (W3 (431.8 mm) length by W4 (279.4 mm) width) is used as the sheet of paper Pp which has a little smaller size than the 12-by-18 inch size.

The waste sheet of paper Pn and the sheet of paper Pp are set in the large capacity feeder 200 or the feeding portion 20 of the image forming apparatus 100.

[Configuration Example of Foil Transferring Apparatus]

Figure 6:
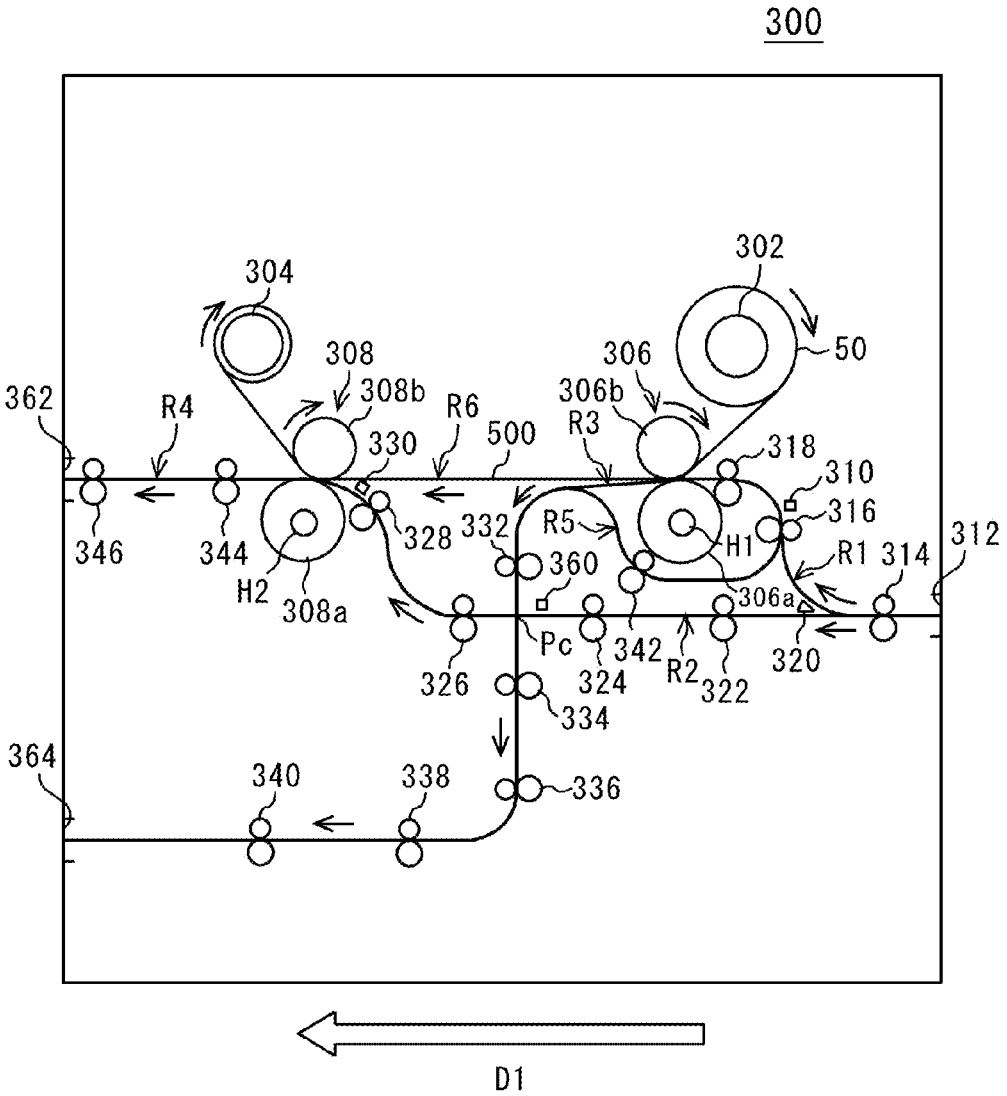
FIG. 6 is a diagram of a foil transferring apparatus showing a configuration example thereof.

The following will describe the foil transferring apparatus 300. FIG. 6 shows a configuration example of the foil transferring apparatus 300. As shown in FIG. 6, the foil transferring apparatus 300 is provided with a setting portion 302, a reel portion 304, a first conveying path R1, a second conveying path R2, a first paper ejection path R3, a second paper ejection path R4, a first thermal transferring portion 306, a second thermal transferring portion 308, a gate switching portion 320, a first detection portion 310, a second detection portion 330 and a sheet detection portion 360. It is to be noted that the setting portion 302 and the reel portion 304 constitute the conveying portion, the first thermal transferring portion 306 constitutes the first transferring portion and the second thermal transferring portion 308 constitutes the second transferring portion.

Figure 7A:
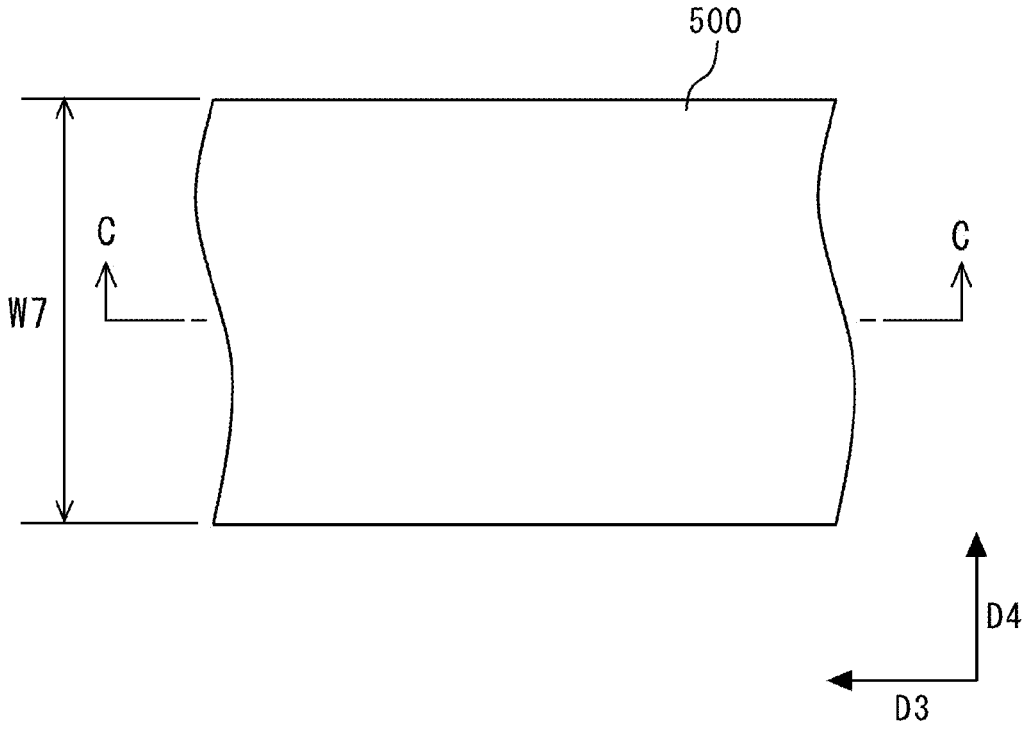
FIG. 7A is an illustration of a foil sheet showing a configuration example thereof and FIG. 7B is a sectional view thereof, taken along lines C-C.
Figure 7B:
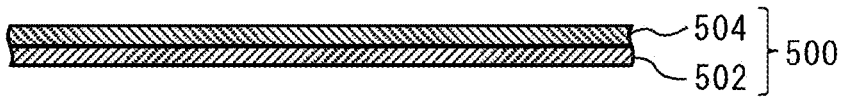

The setting portion 302 is positioned at an upstream side (a side of an entrance 312) along the sheet-conveying direction D1 of the sheet of paper P. The setting portion 302 is composed of, for example, a reel and a cartridge. The setting portion 302 is supported by an axis portion thereof, not shown, so as to be able to rotate. The setting portion 302 sets a roll 50 on which a foil sheet 500 is wound. FIG. 7A shows a configuration example of the foil sheet 500. FIG. 7B shows a section of the foil sheet 500, taken along the lines C-C. As shown in FIGS. 7A and 7B, the foil sheet 500 contains a long substrate 502 made of transparent film of, for example, heat-resistant resin and a foil layer 504 formed on this substrate 502. The foil layer 504 is formed on the substrate 502 by, for example, vaporization. The foil layer 504 is bonded the substrate 502 by van der Waals forces. The foil sheet 500 has a width W7 along a width direction D4 thereof, which is longer than the length W1 of the waste sheet of paper Pn or the length W3 of the sheet of paper Pp.

The reel portion 304 is positioned at a downstream side (a side of an exit 362) along the sheet-conveying direction D1 of the sheet of paper P so as to be away from the setting portion 302 by a predetermined distance. The reel portion 304 includes a reel and is supported by an axis portion thereof, not shown, so as to be able to rotate. In this embodiment, the reel portion 304 is positioned at a level that is the same level as that of the setting portion 302. The reel portion 304 connects, for example, a transfer roller driving portion 370, which will be described later (see FIG. 8). It is configured that the transfer roller driving portion 370 drives the reel portion 304 so as to rotate together with the second thermal transferring portion 308 positioned at the upstream side thereof.

To the reel portion 304, an end of the foil sheet 500 of the roll 50 set on the setting portion 302 is attached with the foil sheet 500 being stretched through the first thermal transferring portion 306 and the second thermal transferring portion 308, which will be described later. When the reel portion 304 rotates, the foil sheet 500 set on the setting portion 302 is conveyed so as to pass through the first thermal transferring portion 306 and the second thermal transferring portion 308 and is wound on the reel portion 304. In this embodiment, a conveying path of the foil sheet 500 between the setting portion 302 and the reel portion 304 is referred to as "foil sheet conveying path R6".

The first conveying path R1 is composed of, for example, a pair of guide plates. The first conveying path R1 extends from the entrance 312 of the foil transferring apparatus 300 to the first thermal transferring portion 306 through the gate switching portion 320. Plural conveying rollers 314, 316 are also positioned on the first conveying path R1. The conveying rollers 314, 316 convey the waste sheet of paper Pn conveyed from the image forming apparatus 100 through the entrance 312 to the registration rollers 318.

The first detection portion 310 is composed of a line sensor in which photoelectric transducers are arranged so as to be lined, an image sensor in which photoelectric transducers are arranged like a matrix and the like. The first detection portion 310 is positioned at an upstream side of the registration rollers 318 along the sheet-conveying direction D1 of the sheet of paper P. The first detection portion 310 detects a position of an end of the waste sheet of paper Pn conveyed through the first conveying path R1. The position of the end of the waste sheet of paper Pn is used when registration fluctuation correction, which will be described later, for aligning the sheet of paper Pp to the waste sheet of paper Pn is performed.

The registration rollers 318 are positioned between the first detection portion 310 and the first thermal transferring portion 306. The registration rollers 318 correct the deflection of the waste sheet of paper Pn by hitting a forward end of the waste sheet of paper Pn against the stopped registration rollers 318 to form a loop (registration correction). The registration rollers 318 restart their rotations to convey the waste sheet of paper Pn to the first thermal transferring portion 306 at a predetermined timing after the registration correction of the waste sheet of paper Pn has finished.

The first thermal transferring portion 306 is positioned at an upstream side of the foil sheet conveying path R6. The first thermal transferring portion 306 contains, for example, a first heating roller 306*a* including a heater H1 and a first pressure roller 306*b* arranged so as to face the first heating roller 306*a*. The registration rollers 318 convey the waste sheet of paper Pn and the first thermal transferring portion 306 lays the foil layer 504 of the foil sheet 500 on top of a surface of the waste sheet of paper Pn, on which the desired negative toner image is transferred, to heat and pressure them. The waste sheet of paper Pn is then adhered to the foil layer 504 and by removing the waste sheet of paper Pn from the foil layer 504, the desired negative foil image is transferred onto the desired negative toner image on the waste sheet of paper Pn. It is to be noted that the heating temperature is preferably about 100° C., for example. The waste sheet of paper Pn on which the desired negative foil image is transferred by the first thermal transferring portion 306 is conveyed to the first paper ejection path R3.

The first paper ejection path R3 is composed of, for example, a pair of guide plates. The first paper ejection path R3 extends diagonally downward along the sheet-conveying direction D1 of the sheet of paper P from the first thermal transferring portion 306. The first paper ejection path R3 also extends by a predetermined length on a vertical direction through a corner portion. The first paper ejection path R3 further extends to the exit 364 through another corner portion. On the first paper ejection path R3, plural paper ejection rollers 332, 334, 336, 338 and 340 are provided. The waste sheet of paper Pn on which the desired negative foil image is transferred by the first thermal transferring portion 306 is conveyed to the exit 364 through the first paper ejection path R3 by the paper ejection rollers 332, 334, 336, 338 and 340.

Reverse conveying path R5 is composed of, for example, a pair of guide plates. The reverse conveying path R5 branches from the first paper ejection path R3 to pass through a position below the first thermal transferring portion 306 and comes together at the upstream side of the conveying rollers 316 on the first conveying path R1. On the reverse conveying path R5, conveying rollers 342 are provided. When using both surfaces of the waste sheet of paper Pn, the waste sheet of paper Pn, on a front surface of which the desired negative foil image has been transferred in the first thermal transferring portion 306, is switched back in the first paper ejection path R3 to enter the reverse conveying path R5 where the waste sheet of paper Pn is reversed and the reversed waste sheet of paper Pn is again fed to the first conveying path R1. Thus, the reverse conveying path R5 is used when using both surfaces of the waste sheet of paper Pn.

The second conveying path R2 is composed of, for example, a pair of guide plates. The second conveying path R2 horizontally extends from the entrance 312 of the foil transferring apparatus 300 to branch from the first conveying path R1 toward the second thermal transferring portion 308 through the gate switching portion 320. The second conveying path R2 intersects the first paper ejection path R3 on the way to the second thermal transferring portion 308. In this embodiment, a position in which the second conveying path R2 and the first paper ejection path R3 are intersected is referred to as an "intersection point Pc". On the second conveying path R2, plural conveying rollers 322, 324 and 326 are provided. The conveying rollers 314, 322, 324 and 326 convey the sheet of paper Pp conveyed from the image forming apparatus 100 through the entrance 312 to the registration rollers 328.

The sheet detection portion 360 is positioned, for example, just before the intersection point Pc on the second conveying path R2. The sheet detection portion 360 is composed of, for example, a sensor of a reflection type or a transmission type. The sheet detection portion 360 detects a forward or rear end of the sheet of paper Pp which passes through the intersection point Pc on the second conveying path R2. This detection result of the sheet of paper Pp is used for conveyance control of the waste sheet of paper Pn which waits or decreases its conveying speed before the intersection point Pc on the first paper ejection path R3.

The second detection portion 330 is composed of a line sensor in which photoelectric transducers are arranged so as to be lined, an image sensor in which photoelectric transducers are arranged like a matrix or the like. The second detection portion 330 is positioned at a downstream side of the registration rollers 328 along the sheet-conveying direction D1 of the sheet of paper P. The second detection portion 330 detects a position of an end of the sheet of paper Pp conveyed through the second conveying path R2.

The registration rollers 328 are positioned at an upstream side of the second thermal transferring portion 308 along the sheet-conveying direction D1 of the sheet of paper P. The registration rollers 328 performs the registration correction to correct the deflection of the sheet of paper Pp by hitting a forward end of the sheet of paper Pp against the registration rollers 328 to form a loop. The registration rollers 328 also performs the registration fluctuation correction to move the sheet of paper Pp along a width direction D2 of the sheet of paper Pp, which is perpendicular to the sheet-conveying direction D1 of the sheet of paper Pp, by a difference between the position of the end of the sheet of paper Pp and the position of the end of the waste sheet of paper Pn with the sheet of paper Pp being nipped. Such registration fluctuation correction enables the end of the sheet of paper Pp to be aligned with the end of the waste sheet of paper Pn. The registration rollers 328 convey the sheet of paper Pp to the second thermal transferring portion 308 to meet the time when the foil sheet 500 having the desired positive foil image reaches the second thermal transferring portion 308 after the registration fluctuation correction has been completed. The registration rollers 328 release the nipping of the sheet of paper Pp and return to their previously set home positions when the sheet of paper Pp reaches the second thermal transferring portion 308.

The second thermal transferring portion 308 is positioned at a downstream side of the foil sheet conveying path R6. The second thermal transferring portion 308 contains a second heating roller 308*a* including a heater H2 and a pressure roller 308*b* arranged so as to face the second heating roller 308*a*. The registration rollers 328 convey the sheet of paper Pp at a predetermined timing to the second thermal transferring portion 308. The second thermal transferring portion 308 lays the foil layer 504 of the foil sheet 500 on top of a surface of the sheet of paper Pp, on which the desired positive toner image is transferred, to heat and pressure them. Accordingly, the desired positive foil image remained on the foil layer 504 is transferred onto the desired positive toner image on the sheet of paper Pp using any confusion action of the toner. It is to be noted that the heating temperature is preferably about 100° C., for example. The sheet of paper Pp on which the desired positive foil image is transferred by the second thermal transferring portion 308 is conveyed to the second paper ejection path R4.

The second paper ejection path R4 is composed of, for example, a pair of guide plates. The second paper ejection path R4 extends from the second thermal transferring portion 308 to an exit 362 horizontally. On the second paper ejection path R4, plural paper ejection rollers 344, 346 are provided. The paper ejection rollers 344, 346 convey the sheet of paper Pp on which the desired positive foil image is transferred by the second thermal transferring portion 308 to the exit 362.

[Block Configuration Example of Image Forming System]

The following will describe a block configuration example of an embodiment of the image forming system GS according to the invention. FIG. 8 illustrates a block configuration example of the image forming system GS. As shown in FIG. 8, the large capacity feeder 200 of the image forming system GS contains a control portion 250 that controls operations of respective portions of the large capacity feeder 200 based on instructions from, for example, a main control portion 150 of the image forming apparatus 100. The control portion 250 includes a central processing unit (CPU) 252 to perform any programs for feeding process, a read only memory (ROM) 254 to store control programs or the like and a random access memory (RAM) 256 to store data temporarily.

The control portion 250 connects the transfer roller driving portion 220, sheet-size detection portions 230, 232 and 234 and a communication portion 290, respectively. The transfer roller driving portion 220 is composed of, for example, a stepping motor. The transfer roller driving portion 220 drives based on a driving signal received from the control portion 250 to convey a sheet of paper P fed from any of the feeding trays 210A, 210B and 210C to the image forming apparatus 100.

The sheet-size detection portion 230 is installed on the feeding tray 210A. The sheet-size detection portion 230 contains a sensor of transmission or reflection type, a variable resistor and an actuator, which are provided to operate together with a regulation plate for regulating a sheet of paper P. The sensor of transmission type detects a size of the sheet of paper P set on the feeding tray 210A based on whether or not the sheet of paper P on the feeding tray 210A is detected at a predetermined position. The variable resistor and the actuator detects a size of the sheet of paper P based on an amount of movement thereof when they move together with the regulation plate or a switch operation. The sheet-size detection portion 230 supplies any acquired information on the sheet size to the control portion 250.

The sheet-size detection portion 232 is installed on the feeding tray 210B. The sheet-size detection portion 232 contains a sensor of transmission or reflection type, a variable resistor and an actuator, which are provided to operate together with the regulation plate for regulating a sheet of paper P. The sheet-size detection portion 232 detects a size of the sheet of paper P set on the feeding tray 210B.

The sheet-size detection portion 234 is installed on the feeding tray 210C. The sheet-size detection portion 234 contains a sensor of transmission or reflection type, a variable resistor and an actuator, which are provided to operate together with the regulation plate for regulating a sheet of paper P. The sheet-size detection portion 234 detects a size of the sheet of paper P set on the feeding tray 210C. It is to be noted that the sheet-size detection portions 232 and 234 have the same configurations as that of the sheet-size detection portion 230, their detailed description of which will be omitted.

The communication portion 290 is composed of various kinds of interfaces such as network interface card (NIC), modulator-DEModulator (MODEM), universal serial bus (USB) and the like. The communication portion 290 receives any instruction information on sheet-feeding from the control portion 150 of the image forming apparatus 100 and transmits it to the control portion 250. The communication portion 290 also transmits the information on the sheet-size detected by the sheet-size detection portions 230, 232, 234 to the image forming apparatus 100.

The image forming apparatus 100 contains the control portion 150 that controls operations of whole of the system. The control portion 150 includes CPU 152 to perform any programs for foil transfer processing together with the large capacity feeder 200 and the foil transferring apparatus 300, ROM 154 to store control programs or the like and RAM 156 to store data temporarily.

The control portion 150 connects the manipulation/display portion 160, the image reading portion 90, the image forming portion 10, the fixing portion 44, the feeding portion 20 and the communication portion 190, respectively.

The manipulation/display portion 160 generates an operation signal corresponding to contents relating to, for example, the foil transfer processing which is selected by the user on its manipulation screen or the like and transmits the operation signal to the control portion 150.

The image reading portion 90 reads an image on the sheet of paper P set on a copy holder or the like under the control of the control portion 150. The image forming portion 10 performs the image forming process such as exposure, development, transfer and the like under the control of the control portion 150.

The fixing portion 44 control temperature of heater(s) under the control of the control portion 150 and heats and pressures the sheet of paper P so as to fix unfixed toner image on the sheet of paper P.

The communication portion 190 is composed of various kinds of interfaces such as NIC, MODEM, USB and the like. The communication portion 190 performs an interactive communication of information relative to the foil transfer processing between the communication portion 290 of the large capacity feeder 200 and the communication portion 390 of the foil transferring apparatus 300.

When the user selects the foil transfer processing mode on the manipulation/display portion 160, the control portion 150 acquires the sheet-size information from each feeding tray 210 of the large capacity feeder 200 through the communication portions 190 and 290. The control portion 150 selects a feeding tray, on which the sheet of paper Pp is set, from the feeding trays 210A, 210B and 210C of the large capacity feeder 200 based on the sheet-size information acquired from each feeding tray 210 of the large capacity feeder 200. The control portion 150 also selects a feeding tray, on which the waste sheet of paper Pn having a larger size than that of the sheet of paper Pp is set, from the feeding trays 210A, 210B and 210C of the large capacity feeder 200 based on the sheet-size information. The control portion 150 further controls the large capacity feeder 200 to feed the waste sheet of paper Pn from the selected feeding tray, controls the image forming apparatus 100 to form the desired negative toner image on the waste sheet of paper Pn and controls the foil transferring apparatus 300 to convey the waste sheet of paper Pn, on which the desired negative toner image is formed, to the first thermal transferring portion 306. The control portion 150 additionally controls the large capacity feeder 200 to feed the sheet of paper Pp from the selected feeding tray, controls the image forming apparatus 100 to form all the toner images including the desired positive toner image on the sheet of paper Pp and controls the foil transferring apparatus 300 to convey the sheet of paper Pp, on which all the toner images are formed, to the second thermal transferring portion 308. It is to be noted that the selection of the sheet of paper Pp and the waste sheet of paper Pn may be performed in the feeding portion 20 of the image forming apparatus 100 in place of the large capacity feeder 200.

The foil transferring apparatus 300 contains a control portion 350 that controls operations of respective portions of the foil transferring apparatus 300 based on instructions from, for example, a main control portion 150 of the image forming apparatus 100. The control portion 350 includes CPU 352 to perform any programs for foil transfer processing, ROM 345 to store control programs or the like and RAM 356 to store data temporarily.

The control portion 350 connects the first thermal transferring portion 306, the second thermal transferring portion 308, the first detection portion 310, the second detection portion 330, the sheet detection portion 360, the gate switching portion 320, an adjustment portion 380, the transfer roller driving portion 370, driving portions 372, 374 for conveying rollers, driving portions 376, 378 for paper ejection rollers, a memory portion 340 and a communication portion 390, respectively.

The first thermal transferring portion 306 performs temperature control and/or pressure control based on a first thermo transferring signal supplied from the control portion 350 to transfer the desired negative foil image on the desired negative toner image of the waste sheet of paper Pn. The second thermal transferring portion 308 also performs temperature control and/or pressure control based on a second thermo transferring signal supplied from the control portion 350 to transfer the desired positive foil image remained on the foil sheet 500 on the desired positive toner image of the sheet of paper Pp.

The first detection portion 310 detects a position of the end of the waste sheet of paper Pn passing through the first conveying path R1 along the direction D2 that is perpendicular to the sheet-conveying direction D1. The first detection portion 310 transmits to the control portion 350 a detection signal obtained by this detection based on the position of the end of the waste sheet of paper Pn. The second detection portion 330 detects a position of the end of the sheet of paper Pp passing through the second conveying path R2 along the direction D2 that is perpendicular to the sheet-conveying direction D1. The second detection portion 330 transmits to the control portion 350 a detection signal obtained by this detection based on the position of the end of the sheet of paper Pp. The sheet detection portion 360 detects the sheet of paper Pp passing through the intersection Pc in the way of the second conveying path R2. The sheet detection portion 360 transmits to the control portion 350 a detection signal obtained by this detection.

The gate switching portion 320 is composed of, for example, solenoid, motor and the like. The gate switching portion 320 switches each of the conveying paths of the waste sheet of paper Pn and the sheet of paper Pp to the first or second conveying path R1 or R2 based on a switching signal supplied from the control portion 350. The adjustment portion 380 is composed of, for example, gears, motor and the like. The adjustment portion 380 moves the registration rollers 328 along the direction D2, which is perpendicular to the sheet-conveying direction D1, based on an instruction value received from the control portion 350.

The transfer roller driving portion 370 is composed of, for example, a stepping motor. The transfer roller driving portion 370 drives based on a driving signal received from the control portion 350 to drive the transfer roller constituting the second thermal transferring portion 308 and to allow the reel portion 304 to rotate together with the driving of the transfer roller. An encoder may be provided to control the winding speed of the reel portion 304. It is to be noted that the reel portion 304 may be configured so as to provide a driving portion other than the transfer roller driving portion 370 to wind the foil sheet.

The driving portion 372 for the conveying rollers is composed of, for example, a stepping motor. The driving portion 372 for the conveying rollers drives based on a driving signal received from the control portion 350 to drive, for example, the conveying rollers 314, 316 and the like provided on the first conveying path R1. The driving portion 374 for the conveying rollers is composed of, for example, a stepping motor. The driving portion 374 for the conveying rollers drives based on a driving signal received from the control portion 350 to drive, for example, the conveying rollers 314, 322, 324, 326 and the like provided on the second conveying path R2.

The driving portion 376 for the paper ejection rollers is composed of, for example, a stepping motor. The driving portion 376 for the paper ejection rollers drives based on a driving signal received from the control portion 350 to drive, for example, the paper ejection rollers 332, 334, 336, 338, 340 and the like provided on the first paper ejection path R3. The driving portion 378 for the paper ejection rollers is composed of, for example, a stepping motor. The driving portion 378 for the paper ejection rollers drives based on a driving signal received from the control portion 350 to drive, for example, the paper ejection rollers 344, 346 and the like provided on the second paper ejection path R4.

The memory portion 340 is composed of, for example, a nonvolatile semiconductor memory, a hard disk drive (HDD)

or the like. The memory portion 340 stores the information on the positions of the ends of the waste sheet of paper Pn and/or the sheet of paper Pp, which are detected by the first and second detection portions 310 and 330. The communication portion 390 is composed of various kinds of interfaces such as NIC, MODEM, USB and the like and performs an interactive communication between the image forming apparatus 100 and the finisher 400.

[Operation Example of Image Forming Apparatus]

Figure 9:
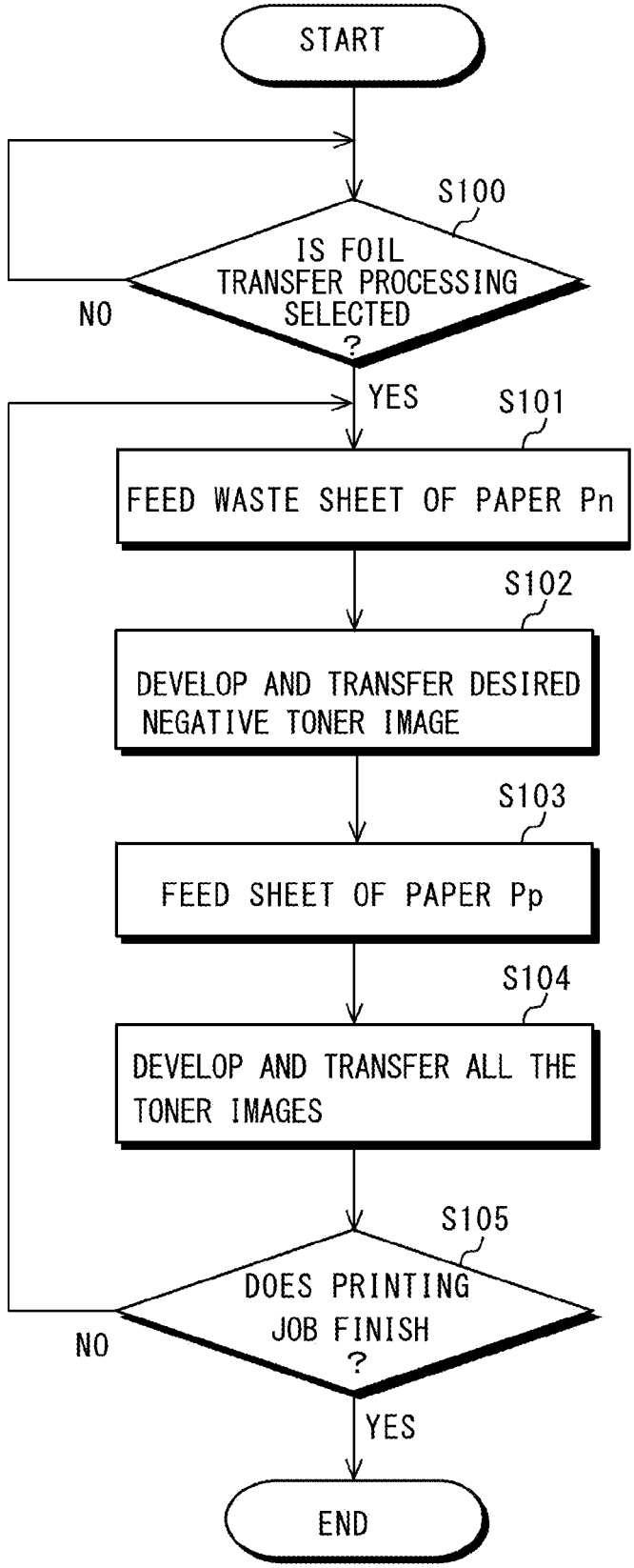
FIG. 9 is a flowchart showing an operation example of the image forming apparatus.

The following will describe an operation example of the image forming apparatus 100 when the desired positive foil image is transferred on the sheet of paper Pp. FIG. 9 shows an operation example of the image forming apparatus 100. In the following description, a case where the waste sheet of paper Pn and the sheet of paper Pp are fed from the feeding trays 210 of the large capacity feeder 200 to the image forming apparatus 100.

As shown in FIG. 9, at a step S100, the control portion 150 determines whether or not the foil transferring process is selected. For example, the control portion 150 determines whether or not a user selects the setting of a foil processing area for performing the foil transferring process on the manipulation screen of the manipulation/display portion 160 and the user selects a button for starting the foil transferring process. The control portion 150 may determine whether or not a computer connecting the image forming apparatus 100 via a network sends any instruction information indicating a start of the foil transferring process. When acquiring a printing job relating to the foil transfer processing and it is determined that the foil transferring process is selected (Yes at the step S100), then the control portion 150 goes to a step S101. If it is determined that the foil transferring process is not selected (No at the step S100), then the control portion 150 waits until the foil transferring process is selected.

At the step S101, the control portion 150 controls the large capacity feeder 200 to feed the waste sheet of paper Pn from the feeding tray 210 to the image forming apparatus 100. For example, when the user selects the size of the sheet of paper Pp on the manipulation screen of the manipulation/display portion 160, the control portion 150 acquires the sheet-size information from the sheet-size detection portions 230, 232 and 234 of the feeding trays 210. The control portion 150 controls the large capacity feeder 200 to automatically select the feeding tray, on which the waste sheet of paper Pn having a larger size than that of the selected sheet of paper Pp is set, from the feeding trays 210A, 210B and 210C based on acquired sheet-size information. The control portion 150 also controls the large capacity feeder 200 to feed the waste sheet of paper Pn from the selected feeding tray to the image forming apparatus 100. When conveying the waste sheet of paper Pn to the image forming apparatus 100, the control portion 150 goes to a step S102.

It is to be noted that if a desired waste sheet of paper Pn is not set in any feeding trays 210, a message such that a desired waste sheet of paper Pn is not set may be displayed on the manipulation screen of the manipulation/display portion 160.

At the step S102, the control portion 150 allows developing and printing the desired negative toner image on the waste sheet of paper Pn fed from the large capacity feeder 200. Namely, the desired negative toner image for removing the unnecessary negative foil image other than the desired positive foil image is transferred on the waste sheet of paper Pn. Specifically, when the desired positive foil image of star image is transferred on the sheet of paper Pp, as shown in FIGS. 4A and 5A, the desired negative toner image 512 which reverses the star image is transferred on the waste sheet of paper Pn. When both surfaces of the waste sheet of paper Pn are used, after the desired negative toner image 512 has been transferred on a front surface of the waste sheet of paper Pn, the waste sheet of paper Pn is reversed in the reverse conveying path 60 and is again conveyed to the image forming portion 10. The desired negative toner image 512 is then transferred on a back surface of the waste sheet of paper Pn. When transferring the desired negative toner image 512 on the waste sheet of paper Pn, the waste sheet of paper Pn is conveyed to the foil transferred apparatus 300 and the control portion 150 goes to a step S103.

At the step S103, the control portion 150 controls the large capacity feeder 200 to feed the sheet of paper Pp from the feeding tray to the image forming apparatus 100. For example, the control portion 150 acquires the sheet-size information from the sheet-size detection portions 230, 232 and 234 of the feeding trays 210. The control portion 150 controls the large capacity feeder 200 to automatically select the feeding tray, on which the sheet of paper Pp having a smaller size than that of the waste sheet of paper Pn is set, from the feeding trays 210A, 210B and 210C based on the acquired sheet-size information. The control portion 150 also controls the large capacity feeder 200 to feed the sheet of paper Pp from the selected feeding tray to the image forming apparatus 100. When conveying the sheet of paper Pp to the image forming apparatus 100, the control portion 150 goes to a step S104.

At the step S104, the control portion 150 allows developing and printing all the toner images including the desired positive toner image on a surface of the sheet of paper Pp fed from the large capacity feeder 200. For example, when the desired positive foil image of star image is transferred on the sheet of paper Pp, as shown in FIGS. 4A and 5A, all the toner images including the desired positive toner image 520 which is identical image to the desired positive foil image, to be transferred, are transferred on the suitable position of the sheet of paper Pp. Thus, in this embodiment, based on number of images (print numbers), the transfer of the desired negative toner image on the waste paper of paper Pn and the transfer of all the toner images including the desired positive toner image on the sheet of paper Pp are alternatively performed. For example, in a case of one image, a total of two sheets of the waste sheet of paper Pn and the sheet of paper Pp one by one are fed to the image forming apparatus 100. When both surfaces of the waste sheet of paper Pn are used and two images are set, a total of three sheets of one waste sheet of paper Pn and two sheets of paper Pp are fed to the image forming apparatus 100. When conveying the waste sheet of paper Pn and the sheet of paper Pp to the image forming apparatus 100, the control portion 150 goes to a step S105.

At the step S105, the control portion 150 determines whether or not the printing job finishes. For example, the control portion 150 determines whether or not all the positive toner images including the desired positive toner image and the desired negative toner image are transferred according to the user's set number of the images in the foil transfer processing. If the control portion 150 determines that the printing job finishes, then the control portion 150 finishes the image forming process on a series of foil transfer processing. On the other hand, if the control portion 150 determines that the printing job has not yet finished, the control portion 150 goes back to the step S101 from which the above-mentioned image forming process is repeated.

[Operation Example of Foil Transferring Apparatus]

Figure 10:
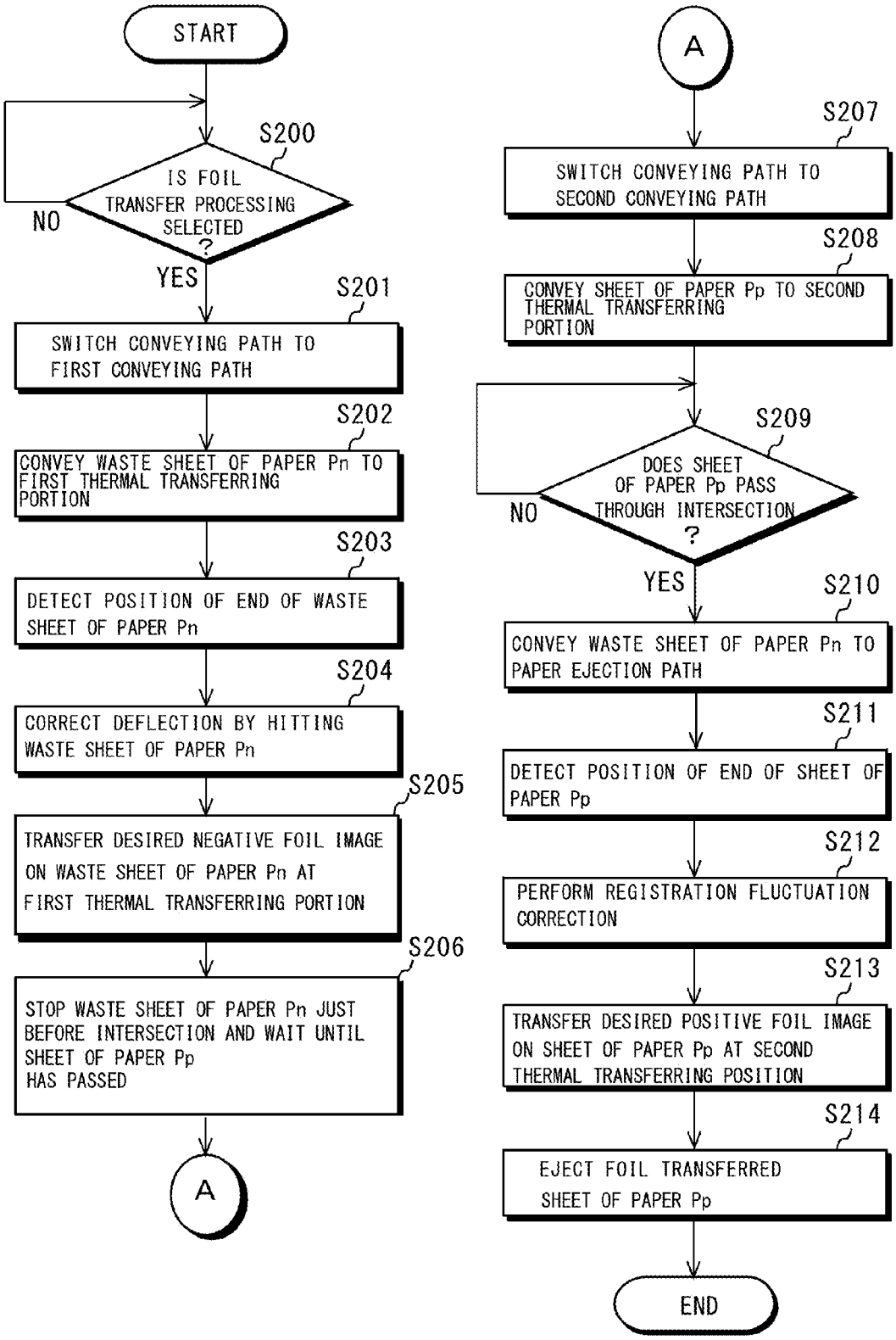
FIG. 10 is a flowchart showing an operation example of the foil transferring apparatus.
Figures 11A, 11B, 11C, 11D:
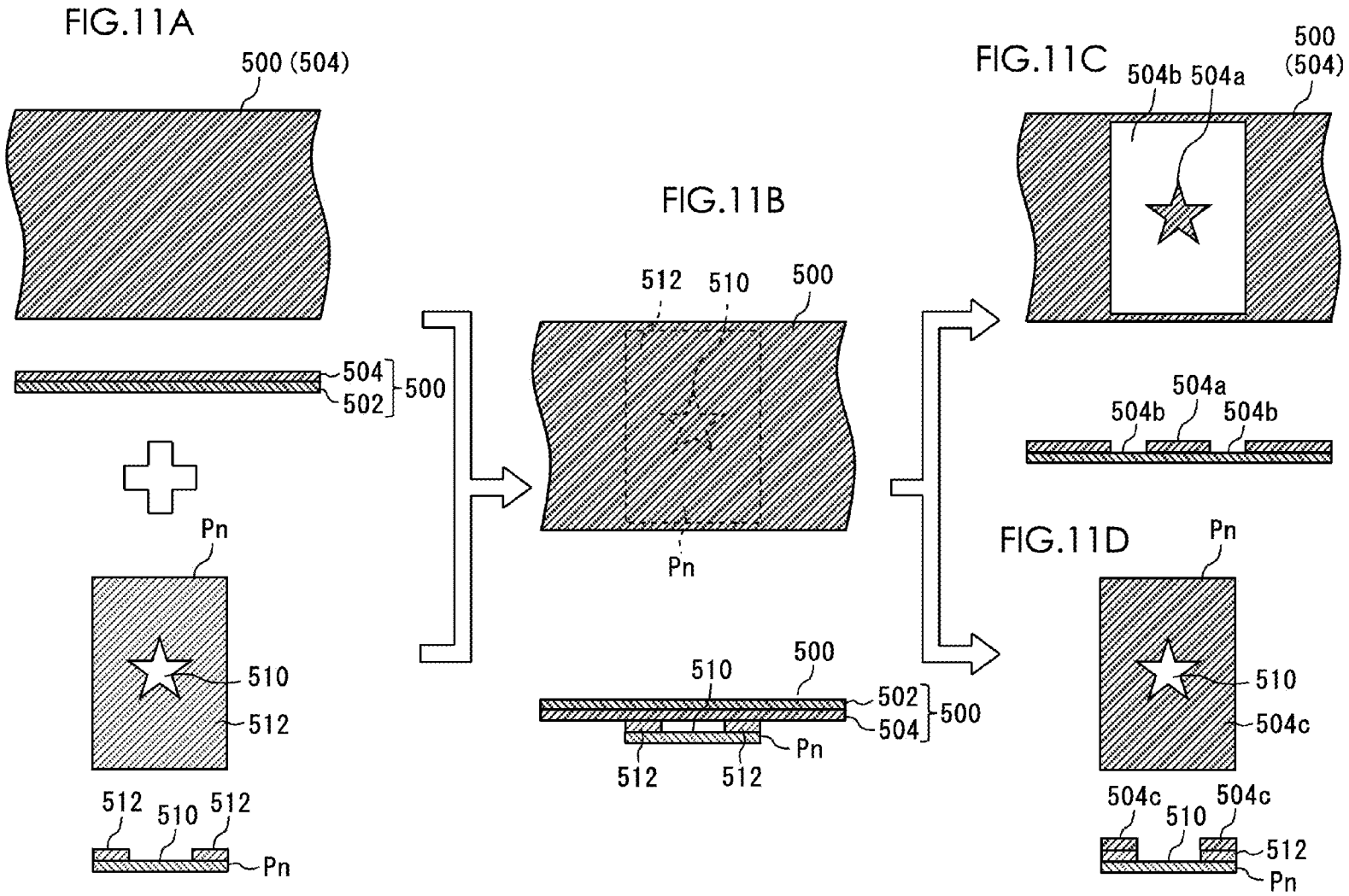
FIGS. 11A through 11D are illustrations of the foil sheet and the waste sheet of paper Pn explaining their conditions.
Figures 12A, 12B, 12C, 12D:
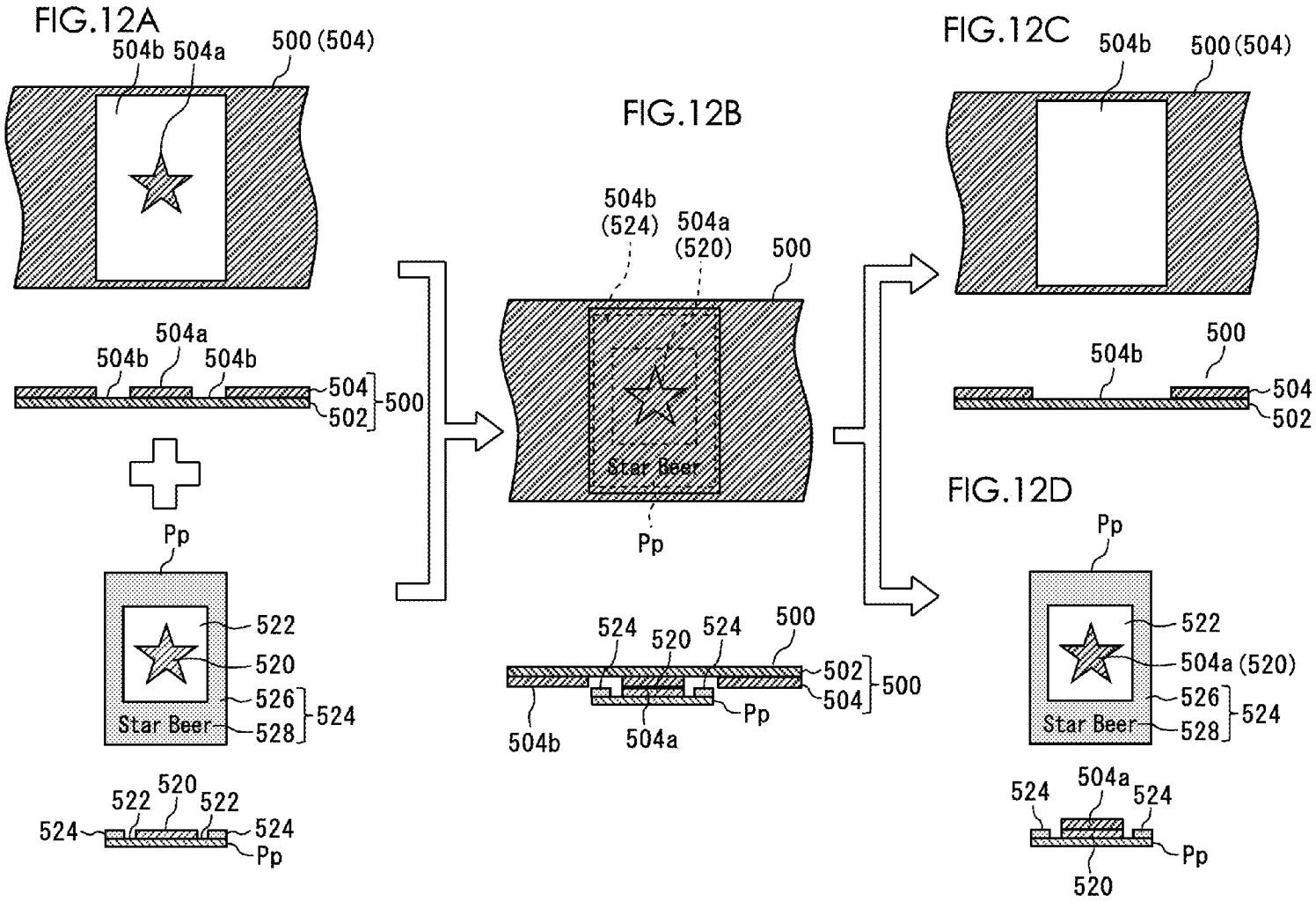
FIGS. 12A through 12D are illustrations of the foil sheet and the sheet of paper Pp explaining their conditions.
Figure 13A:
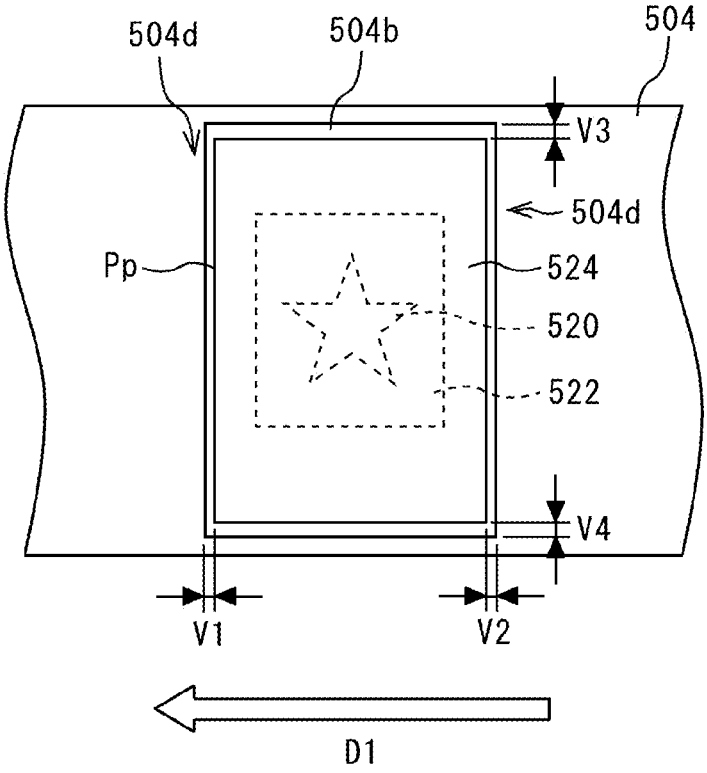
FIGS. 13A and 13B are diagrams showing an example of positional relationship between a desired positive foil image on the foil sheet and designs of the sheet of paper Pp.

The following will describe an operation example of the foil transferring apparatus 300. FIG. 10 shows an operation example of the control portion 350 of the foil transferring apparatus 300. FIGS. 11A through 11D illustrate the foil sheet 500 and the waste sheet of paper Pn explaining their conditions. FIGS. 12A through 12D are illustrations of the foil sheet 500 and the sheet of paper Pp explaining their conditions. FIG. 13A enlarges FIG. 12B. It is to be noted that in FIG. 13A, the foil sheet 500 and the sheet of paper Pp are seen from a side of the sheet of paper Pp and that hatching and the like are omitted therefrom for convenience' sake.

As shown in FIG. 10, at a step S200, the control portion 350 determines whether or not the foil transferring process is selected. For example, the control portion 350 determines whether or not it receives any selection information indicating a selection of the foil transferring process from the image forming apparatus 100. If it is determined that the foil transferring process is selected, then the control portion 350 goes to a step S201. If it is determined that the foil transferring process is not selected, then the control portion 350 waits until the foil transferring process is selected.

At the step S201, the control portion 350 controls the gate switching portion 320 to switch the conveying path (entrance gate) to the first conveying path R1. When the conveying path is switched to the first conveying path R1, the control portion 350 goes to a step S202. Further, when selecting the foil transferring process, the control portion 350 controls the transfer roller driving portion 370 to drive so that the reel portion 304 winds the foil sheet 500 set on the setting portion 302.

At the step S202, the control portion 350 controls the driving portion 372 for the conveying rollers 314, 316 to rotate them so that the waste sheet of paper Pn, on which the desired negative toner image is transferred, the waste sheet of paper Pn being conveyed from the image forming apparatus 100, is conveyed to the first thermal transferring portion 306 through the first conveying path R1. Namely, the waste sheet of paper Pn having a larger size than that of the sheet of paper Pp is conveyed to the first thermal transferring portion 306.

At a step S203, the first detection portion 310 detects the position of the end of the waste sheet of paper Pn, along the direction d2 that is perpendicular to the sheet-conveying direction, which is conveyed toward the first thermal transferring portion 306. The control portion 350 acquires any information on the position of the end of the waste sheet of paper Pn, which is detected by the first detection portion 310, and controls the memory portion 340, for example, to store the acquired information on the position of the end of the waste sheet of paper Pn. If the acquired information on the position of the end of the waste sheet of paper Pn is stored on the memory portion 340, then the control portion 350 goes to a step S204.

At the step S204, the control portion 350 controls the registration rollers 318 to stop so that the deflection of the waste sheet of paper Pn conveying through the first conveying path R1 is corrected by hitting a forward end of the waste sheet of paper Pn against the stopped registration rollers 318 to form a loop. If the deflection of the waste sheet of paper Pn is corrected, then the control portion 350 controls the registration rollers 318 and the like to convey the waste sheet of paper Pn to the first thermal transferring portion 306 at a predetermined timing and goes to a step S205.

At the step S205, the control portion 350 controls the first thermal transferring portion 306 to lay the foil layer 504 of the foil sheet 500 on top of a surface of the waste sheet of paper Pn, on which the desired negative toner image is transferred, to heat and pressure them. Thus, the desired negative foil image is transferred onto the desired negative toner image on the waste sheet of paper Pn. Specifically, as shown in FIGS. 11A and 11B, the first thermal transferring portion 306 lays the foil layer 504 of the foil sheet 500 on top of the surface of the waste sheet of paper Pn, on which the desired negative toner image 512 is transferred, to heat and pressure them. Thus, as shown in FIG. 11D, the desired negative foil image 504*c* that corresponds to the sheet size of the waste sheet of paper Pn and excludes the desired positive foil image 504*a* of star image is transferred on the desired negative toner image 512 of the waste sheet of paper Pn. On the other hand, as shown in FIG. 11C, the desired positive foil image 504*a* of star image, to be transferred on the sheet of paper Pp, remains in the foil layer 504 of the foil sheet 500 and the recessed portion 504*b* in which excessive foil having the same size as that of the waste sheet of paper Pn is formed. If the desired negative foil image 504*c* is transferred on the waste sheet of paper Pn, then the control portion 350 goes to a step S206.

At the step S206, the control portion 350 controls the driving portion 376 for paper ejection rollers to rotate the paper ejection rollers 332 and the like so that the waste sheet of paper Pn on which the desired negative foil image is transferred by the first thermal transferring portion 306 is conveyed to the first paper ejection path R3. In this moment, in order to avoiding conflicting the waste sheet of paper Pn with the sheet of paper Pp at the intersection Pc, the waste sheet of paper Pn stops just before the intersection Pc and waits until the sheet of paper Pp passes through the intersection Pc. Further, the control portion 350 may control the driving portion 376 for paper ejection rollers to reduce a conveying speed of the waste sheet of paper Pn. If the waste sheet of paper Pn is conveyed to the first paper ejection path R3, then the control portion 350 goes to a step S207.

At the step S207, the control portion 350 controls the gate switching portion 320 to switch the conveying path to the second conveying path R2. For example, a sensor may be provided near the entrance 312 and the gate switching portion 320 may switch the conveying path after a predetermined period of time has elapsed since this sensor has detected the waste sheet of paper Pn. The detection result of the first detection portion 310 may trigger the switch of the gate switching portion 320. If the conveying path is switched to the second conveying path R2, then the control portion 350 goes to a step S208.

At the step S208, the control portion 350 controls the driving portion 374 for the conveying rollers 322, 324, 326 to rotate them so that the sheet of paper Pp conveyed from the image forming apparatus 100 is conveyed to the second thermal transferring portion 308 through the second conveying path R2. In this moment, the control portion 350 controls the driving portion 374 for the conveying rollers 322, 324, 326 to increase a conveying speed of the sheet of paper Pp to convey the sheet of paper Pp to the registration rollers 328 which are provided just before the second thermal transferring portion 308, before the foil sheet 500, from which the desired negative foil image is removed by the first thermal transferring portion 306, has reached the second thermal transferring portion 308. If the sheet of paper Pp is conveyed to the second conveying path R2, then the control portion 350 goes to a step S209.

At the step S209, the control portion 350 determines whether or not the sheet of paper Pp passes through the intersection Pc of the second conveying path R2. For example, the control portion 350 determines whether or not the detection signal output from the sheet detection portion 360 is turned from on to off based on the passing of the end of the waste sheet of paper Pn. If it is determined that the sheet of paper Pp passes through the intersection Pc, then the control portion 350 goes to a step S210. On the other hand, if it is determined that the sheet of paper Pp does not pass through the intersection Pc, then the control portion 350 continues to watch until the sheet of paper Pp passes through the intersection Pc.

At the step S210, the control portion 350 controls the driving portion 376 for the paper ejection rollers to rotate the paper ejection rollers 332, 334, 336, 338 and 340 after the sheet of paper Pp passes through the intersection Pc so that the waste sheet of paper Pn, on which the desired negative foil image is transferred by the first thermal transferring portion 306, is ejected to the finisher 400 through the exit 364. If the waste sheet of paper Pn is conveyed, then the control portion 350 goes to a step S211.

At the step S211, the second detection portion 330 detects the position of the end of the sheet of paper Pp, along the direction D2 that is perpendicular to the sheet-conveying direction D1, which is conveyed toward the second thermal transferring portion 308. The control portion 350 acquires any information on the position of the end of the sheet of paper Pp, which is detected by the second detection portion 330, and controls the memory portion 340, for example, to store the acquired information on the position of the end of the sheet of paper Pp. If the acquired information on the position of the end of the sheet of paper Pp is stored on the memory portion 340, then the control portion 350 goes to a step S212.

At the step S212, the control portion 350 controls the registration rollers 328 to perform the registration fluctuation correction on the sheet of paper Pp, the position of the end of which is detected by the second detection portion 330. Specifically, the control portion 350 reads out of the memory portion 340 the information on the position of the end of the waste sheet of paper Pn acquired in the step S203 and the information on the position of the end of the sheet of paper Pp acquired in the step S211. The control portion 350 calculates a difference between the read information on the position of the end of the sheet of paper Pp and the read information on the position of the end of the waste sheet of paper Pn to calculate an amount of misregistration of the sheet of paper Pp in relation to the waste sheet of paper Pn along the direction D2 that is perpendicular to the sheet-conveying direction D1. The control portion 350 prepares a command based on the calculated amount of misregistration and outputs the command to the adjustment portion 380. The control portion 350 controls the adjustment portion 380 to be driven based on the command and to allow the registration rollers 328 to perform the registration fluctuation correction in which the registration rollers 328 moves along the direction D2 with the sheet of paper Pp being nipped. Accordingly, it is possible to align the desired positive toner image of the sheet of paper Pp with the desired positive foil image of the foil sheet 500. It is to be noted that the deflection of the sheet of paper Pp may be corrected by hitting the forward end of the sheet of paper Pp against the registration rollers 328 before this registration fluctuation correction.

After the registration fluctuation correction is finished, the control portion 350 calculates time when the desired positive foil image remained in the foil sheet 500 reaches the second thermal transferring portion 308 based on the timing in which the waste sheet of paper Pn starts from the registration rollers 318 at the step S204. For example, the control portion 350 calculates time when the desired positive foil image on the foil sheet 500 reaches the second thermal transferring portion 308 based on a conveying speed of the waste sheet of paper Pn, a conveying speed of the foil sheet 500 and a distance to be conveyed between the first and second thermal transferring portions 306, 308 or the like. The control portion 350 controls the registration rollers 318 to be driven at the conveying start timing thereof to convey the desired positive toner image on the sheet of paper Pp to the second thermal transferring portion 308 at the calculated time when the desired positive foil image remained in the foil sheet 500 reaches the second thermal transferring portion 308. In this embodiment, since the waste sheet of paper Pn having the larger size than that of the sheet of paper Pp, the sheet of paper Pp is conveyed so that any spaces (spaces V1 through V4 shown in FIGS. 13A and 13B) can occur between each edge of the sheet of paper Pp and each outer edge of the recessed portion 504*b* in the foil layer 504 of the foil sheet 500, from which the foil layer 504 is removed by the desired negative toner image.

Figure 13B:
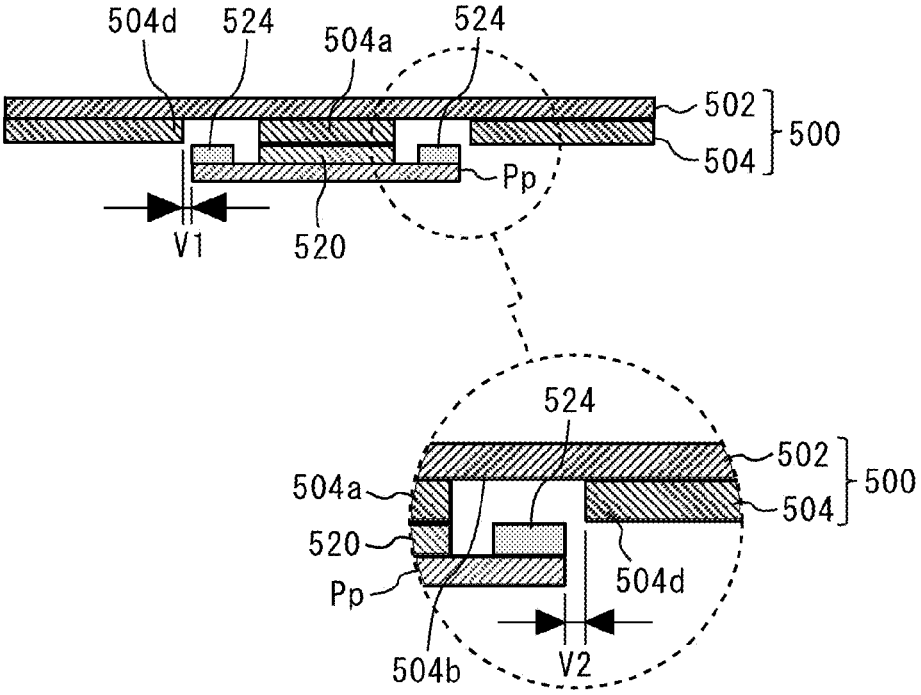

At a step S213, the control portion 350 controls the second thermal transferring portion 308 to lay the foil layer 504 of the foil sheet 500 on top of a surface of the sheet of paper Pp, on which the desired positive toner image 520 is transferred, to heat and pressure them. Thus, the desired positive foil image is transferred from the foil sheet 500 onto the desired positive toner image on the sheet of paper Pp. Specifically, as shown in FIGS. 12A and 12B, the second thermal transferring portion 308 lays the foil layer 504 of the foil sheet 500 on top of the surface of the sheet of paper Pp, on which the desired positive toner image 520 is transferred, to heat and pressure them. In this embodiment, since the sheet of paper P having the larger size than that of the sheet of paper Pp is used as the waste sheet of paper Pn, as shown in FIGS. 13A and 13B, the spaces V1 through V4 occur between each edge of the design 524 of the sheet of paper Pp and each inner edge of the foil 504*d* constituting the recessed portion 504*b* in the foil layer 504 of the foil sheet 500, from which the foil layer 504 is removed by the desired negative toner image 512. Accordingly, even if the sheet of paper Pp is slightly shifted to put the foil sheet on top of the shifted sheet of paper Pp or the sheets of paper Pp are slightly different in their sizes, these shifts and/or difference are solved by these spaces V1 through V4. Thus, it is capable of preventing the design 524 of the sheet of paper Pp from being put under the inner edge of the foil 504*d* of the foil 504. Thus, as shown in FIG. 12D, only the desired positive foil image 504*a* of star image, which remains in the foil sheet 500, is transferred on the desired positive toner image 520 of the sheet of paper Pp. On the other hand, as shown in FIG. 12C, the desired positive foil image 504*a* of star image, to be printed, is removed from the base member 502 so that in the foil layer 504 of the foil sheet 500, the recessed portion 504*b* corresponding to the size of the waste sheet of paper Pn is formed. If the desired positive foil image 504*a* is transferred on the sheet of paper Pp, the control portion 350 goes to a step S214 of FIG. 10.

At the step S214, the control portion 350 controls the driving portion 378 for paper ejection rollers to rotate the paper ejection rollers 344, 346 so that the sheet of paper Pp, on which the desired foil image is transferred, is ejected to the finisher 400 through the exit 362.

As described above, according to the image forming system GS as this embodiment, since the waste sheet of paper Pn having the larger size than that of the sheet of paper Pp is used, and the desired negative toner image 512, on which the desired negative foil image is transferred, is formed on the waste sheet of paper Pn, it is possible to form on the foil sheet 500 the recess portion, from which the foil layer 504 is removed by the foil transfer processing of the first thermal transferring portion 306. The recess portion has larger space than the size of the sheet of paper Pp. This enables any spaces to occur between each edge of the design 524 of the sheet of paper Pp and each inner edge of the foil 504*d* constituting the recessed portion 504*b* in the foil layer 504 of the foil sheet 500, from which the foil layer 504 is removed by the desired negative toner image 512 on the waste sheet of paper Pn, when the design 524 is formed on an end of the sheet of paper Pp. As a result thereof, even if the sheet of paper Pp is slightly shifted to put the foil sheet 500 on top of the shifted sheet of paper Pp or the sheets of paper Pp are slightly different in their sizes when the waste sheet of paper Pn has a smaller size than that of the foil sheet 500, it is possible to prevent the foil 504*d* of the foil sheet 500 from being transferred to an edge of the design 524 of the sheet of paper Pp. Thus, it is possible to transfer the desired positive foil image 504*a* on the sheet of paper Pp so that it is realize the foil transfer processing with high positional accuracy and high quality.

Further, according to the image forming system GS of this first embodiment, it is possible to perform the foil transfer processing rapidly and continuously, so that the productivity thereof can be improved. Additionally, in the image forming system GS, the universal tray such as the large capacity feeder 200 is used, so that the image forming system GS can handle the sheets of paper P having any kinds of sizes flexibly. This enables the image forming system GS which becomes more convenient to be presented.

Further, according to this first embodiment, the sheet of paper Pp aligns the waste sheet of paper by shifting the sheet of paper Pp by an amount of deflection of the waste sheet of paper Pn at a preceding step of conveying the waste sheet of paper Pn to the second thermal transferring portion 308 so that it is possible to transfer the desired positive foil image on the sheet of paper Pp with high positional accuracy.

Additionally, according to this first embodiment, since both surfaces of the waste sheet of paper Pn may be used by providing with the reverse conveying path R5, numbers of the waste sheet of paper Pn disposed in the course of transferring the foil may be automatically reduced by half without taking a lot of time.

Second Embodiment

The second embodiment is different from the first embodiment in that the waste sheet of paper Pn has a size that is at least twice as large as that of the sheet of paper Pp and plural desired negative toner images are transferred on the waste sheet of paper Pn. It is to be noted that other configuration of the image forming system GS is identical to that of the above-mentioned first embodiment so that the common components are referred by the same symbols and their detailed explanation will be omitted.

[Configuration Example of Waste Sheet of Paper Pn as First Base Material]

Figure 14A:
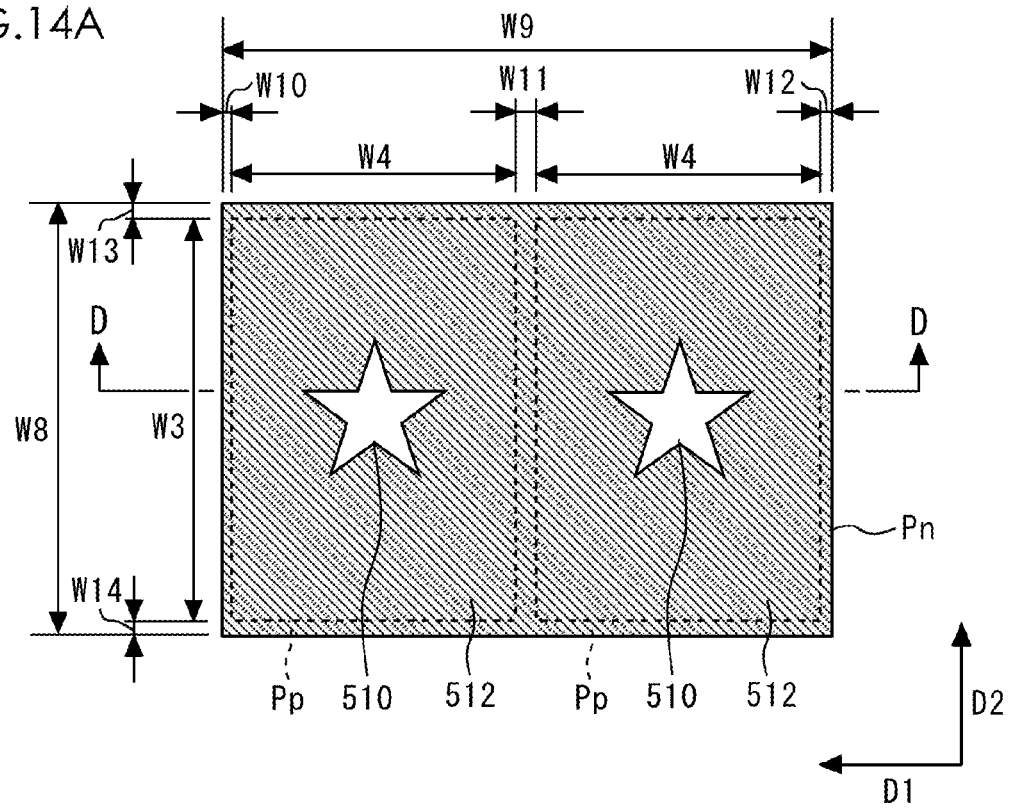
FIG. 14A is an illustration of a waste sheet of paper Pn which is used in the foil transfer processing of the foil transferring apparatus in the image forming system according to a second embodiment of this invention and FIG. 14B is a sectional view thereof, taken along lines D-D.
Figure 14B:
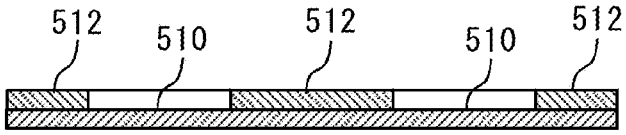

The following will describe the configuration example of waste sheet of paper Pn used in the foil transfer processing of the image forming system GS according to the second embodiment of this invention. FIG. 14A shows the configuration example of the waste sheet of paper Pn used in the second embodiment. FIG. 14B is a sectional view thereof, taken along lines D-D. It is to be noted that in FIGS. 14A and 14B, a case where two desired negative toner images 512 are transferred is shown. The sheets of paper Pp corresponding to the waste sheet of paper Pn are shown by broken lines in the waste sheet of paper Pn. The sheets of paper Pp, each of which is identical with the sheet of paper Pp described in the first embodiment, are used in this embodiment.

As shown in FIGS. 14A and 14B, the waste sheet of paper Pn has a larger size than sizes of two sheets of paper Pp arranged parallel with each other along the sheet-conveying direction D1 (more than twice). Specifically, a width W9 of the waste sheet of paper Pn along the sheet-conveying direction D1 is at least twice as large as a width W4 of the sheet of paper Pp and is longer by the lengths W10, W11 and W12. Further, a length W8 of the waste sheet of paper Pn along the direction D2 that is perpendicular to the sheet-conveying direction D1 is longer than length W3 of the sheet of paper Pp along the direction D2 by the lengths W13 and W14.

Two desired negative toner images 512, 512 are transferred on the waste sheet of paper Pn. In this embodiment, these desired negative toner images 512, 512 are transferred at the same time. The recessed portions 510, 510, from which the star images are removed, are formed on the desired negative toner images 512, 512. The use of such waste sheet of paper Pn enables spaces (of lengths W10, W12, W13 and W14) to occur between each edge (the design) of each of the sheets of paper Pp and each inner edge of the foil constituting the recessed portion in the foil layer of the foil sheet 500, from which the foil layer is removed by the desired negative toner images 512 on the waste sheet of paper Pn, when laying the foil sheet 500 on top of the sheet of paper Pp. A length W11 is formed taking a length between the sheets of paper Pp and Pp into consideration.

Although, as the waste sheet of paper Pn, a sheet of paper having a size that is twice as slightly large as that of the sheet of paper Pp along the sheet-conveying direction D1 has been used in this embodiment, this invention is not limited thereto: The waste sheet of paper Pn can have a size that is three times (integral multiple thereof) as large as that of the sheet of paper Pp. Further, a multiple of desired negative toner images 512 can be transferred on the waste sheet of paper Pn along the direction D2 that is perpendicular to the sheet-conveying direction D1 using a sheet of paper having a size that is at least twice as large as that of the sheet of paper Pp along the direction D2 that is perpendicular to the sheet-conveying direction D1 according to a length of the foil sheet 500 along the direction (width direction) D2.

[Operation Example of Image Forming System]

The following will describe an operation example of the image forming system GS in which plural desired negative toner images are transferred on the waste sheet of paper Pn. First, an operation example of the image forming apparatus 100 will be described. It is to be noted that the foil transfer operation when plural desired negative toner images are transferred on the waste sheet of paper Pn is basically common to the foil transfer operation described in the first embodiment so that the foil transfer operations that are different from the foil transfer operation described in the first embodiment are principally described.

The control portion 150 determines whether or not multiple-foils-transferring mode in the foil transfer processing is selected on the manipulation screen of the manipulation/display portion 160. When selecting the foil transfer processing mode, a selection button for selecting how many desired negative toner images are transferred on the waste sheet of paper Pn is displayed on the manipulation screen. In this embodiment, as shown in FIGS. 14A and 14B, the multiple-foils-transferring mode in which two desired negative toner images 512 are transferred is selected.

When selecting the multiple-foils-transferring mode in the foil transfer processing, the control portion 150 selects from the feeding trays of the large capacity feeder 200 the feeding tray 210 in which the waste sheet of paper Pn corresponding to the multiple-foils-transferring mode is set. In this embodiment, the feeding tray 210 is selected in which the waste sheet of paper Pn having the size that is at least twice as large as that of the sheet of paper Pp is set. The control portion 150 controls the large capacity feeder 200 to feed the waste sheet of paper Pn from the selected feeding tray 210 and to convey the waste sheet of paper Pn to the image forming apparatus 100. On the other hand, if the waste sheet of paper Pn corresponding to the multiple-foils-transferring mode is not set in any of the feeding trays 210, a message such as "the waste sheet of paper Pn corresponding to the multiple-foils-transferring mode is not set" is displayed on, for example, the manipulation screen of the manipulation/display portion 160.

When feeding the waste sheet of paper Pn to the image forming apparatus 100, the control portion 150 controls the image forming portion 10 to develop and transfer the desired negative toner images 512 for removing the desired negative foil images from the foil sheet 500 and transferring the desired negative foil images on the waste sheet of paper Pn. Specifically, as shown in FIGS. 14A and 14B, two desired negative toner images 512 are transferred on the waste sheet of paper Pn. The transferred waste sheet of paper Pn is conveyed to the foil transferring apparatus 300.

When feeding the waste sheet of paper Pn in the large capacity feeder 200, the control portion 150 follows to select from the feeding trays of the large capacity feeder 200 another feeding tray 210 in which the sheet of paper Pp having a size that is less than half of that of the waste sheet of paper Pn is set. The control portion 150 controls the large capacity feeder 200 to feed the sheet of paper Pp from the selected feeding tray 210 and to convey the sheet of paper Pp to the image forming apparatus 100. In this embodiment, the multiple-foils-transferring mode of two sheets of paper Pp is selected so that two sheets of paper Pp are successively fed to the image forming apparatus 100. On the other hand, if the sheet of paper Pp corresponding to the multiple-foils-transferring mode is not set in any of the feeding trays 210, a message such as "the sheet of paper Pp corresponding to the multiple-foils-transferring mode is not set" is displayed on, for example, the manipulation screen of the manipulation/display portion 160, which is similar to a case of the waste sheet of paper Pn.

When feeding the sheet of paper Pp to the image forming apparatus 100, the control portion 150 controls the image forming portion 10 to develop and transfer all the toner images including the desired positive toner images 520 on a surface of the sheet of paper Pp. In this embodiment, the multiple-foils-transferring mode of two sheets of paper Pp is selected so that all the toner images including the desired positive toner images 520 are transferred on two sheets of paper Pp, respectively. The transferred sheets of paper Pp are conveyed to the foil transferring apparatus 300.

Next, the following will describe the operation example of the foil transferring apparatus 300. When conveying the waste sheet of paper Pn, on which the desired negative toner images 512 are transferred, from the image forming apparatus 100 to the first thermal transferring portion 306, the first thermal transferring portion 306 lays the foil layer 504 of the foil sheet 500 on top of a surface of the waste sheet of paper Pn, on which the desired negative toner images 512 are transferred, to heat and pressure them. The desired negative foil images are transferred on the desired negative toner images 512 of the waste sheet of paper Pn using their fusing actions and then are removed from the foil layer 504. In this embodiment, the desired negative foil images 504*c*, 504*c* are transferred on two desired negative toner images 512, 512 transferred on the waste sheet of paper Pn and then are removed from the foil layer 504 of the foil sheet 500. Thus, the desired negative foil images are removed from the foil sheet 500 so that two desired positive foil images 504*a*, 504*a* remain on the foil sheet 500. When finishing the transferring the desired negative foil images on the desired negative toner images 512, the foil sheet 500 is conveyed to the second thermal transferring portion 308 and the waste sheet of paper Pn is ejected to outside.

Next, when conveying the sheet of paper Pp, on which the desired positive toner images 520 are transferred, from the image forming apparatus 100 to the second thermal transferring portion 308, the sheet of paper Pp is conveyed to the second thermal transferring portion 308 at timing when the desired positive foil images 504*a*, 504*a* remained on the foil sheet 500 reach the second thermal transferring portion 308. In this embodiment, the multiple-foils-transferring mode of two sheets of paper Pp is selected so that two sheets of paper Pp are successively fed to the second thermal transferring portion 308. In this moment, two sheets of paper Pp are successively fed to the second thermal transferring portion 308 so that the spaces (of lengths W10, W12, W13 and W14 as shown in FIG. 14A) occur between each edge of each of the sheets of paper Pp and each inner edge of the foil constituting the recessed portion in the foil layer of the foil sheet 500, from which the foil layer is removed by the desired negative toner images 512 on the waste sheet of paper Pn. In the second thermal transferring portion 308, a first desired positive foil image 504*a* remained on the foil sheet 500 is then transferred on the desired positive toner image 520 of the first sheet of paper Pp. Further, a second desired positive foil image 504*a* remained on the foil sheet 500 is transferred on the desired positive toner image 520 of the second sheet of paper Pp. In this embodiment, such a series of operations is repeatedly performed.

As described above, according to the image forming system GS as this second embodiment, since the waste sheet of paper Pn having the larger size than that of the sheet of paper Pp is used, which is similar to the first embodiment, it is possible to prevent the outer foil 504*d* of the foil sheet 500 from being transferred to an edge of the design 524 of the sheet of paper Pp. As a result thereof, it is possible to transfer the desired positive foil image 504*a* on the sheet of paper Pp and it is possible to realize the foil transfer processing with high positional accuracy and high quality.

Further, according to the image forming system GS of this second embodiment, it is possible to perform the plural desired negative toner images 512 on the one waste sheet of paper Pn at the same time because the waste sheet of paper Pn having a size that is at least twice as large as that of the sheet of paper Pp is used. Accordingly, unnecessary waste of the waste sheet of paper Pn can be avoided. When both surfaces of the waste sheet of paper Pn are used, unnecessary waste of the waste sheet of paper Pn can be further avoided.

Although a user has previously specified the size or the like of the sheet of paper Pp in the first and second embodiments, this invention is not limited thereto: When selecting the foil transfer processing mode, the control portion 150 may select the sizes of the sheet of paper Pp and the waste sheet of paper Pn automatically and determine whether or not the selected sheet of paper Pp and/or the selected waste sheet of paper Pn are set in the large capacity feeder 200 or the like.

Third Embodiment

The third embodiment is different from the first embodiment in that transparent toner is used in the image forming portion 10 and an enlarged toner image is used as the desired positive toner image. It is to be noted that other configuration of the image forming system GS is identical to that of the above-mentioned first embodiment so that the common components are referred by the same symbols and their detailed explanation will be omitted.

[Configuration Example of Image Forming System]

The following will describe a configuration example of the image forming system GS according to the third embodiment of this invention. The image forming system GS according to the third embodiment of this invention may be configured so as to be identical to that of the first embodiment of this invention as shown in FIG. 2 so that the description of common components will be omitted.

The manipulation/display portion 160 allows the user to set a contour region, to be enlarged, of the desired positive toner images in order to perform the foil transfer processing as conditions relative to the foil transfer processing, in addition to the selection of foil transfer processing area.

[Configuration Example of Image Forming Apparatus]

Figure 15:
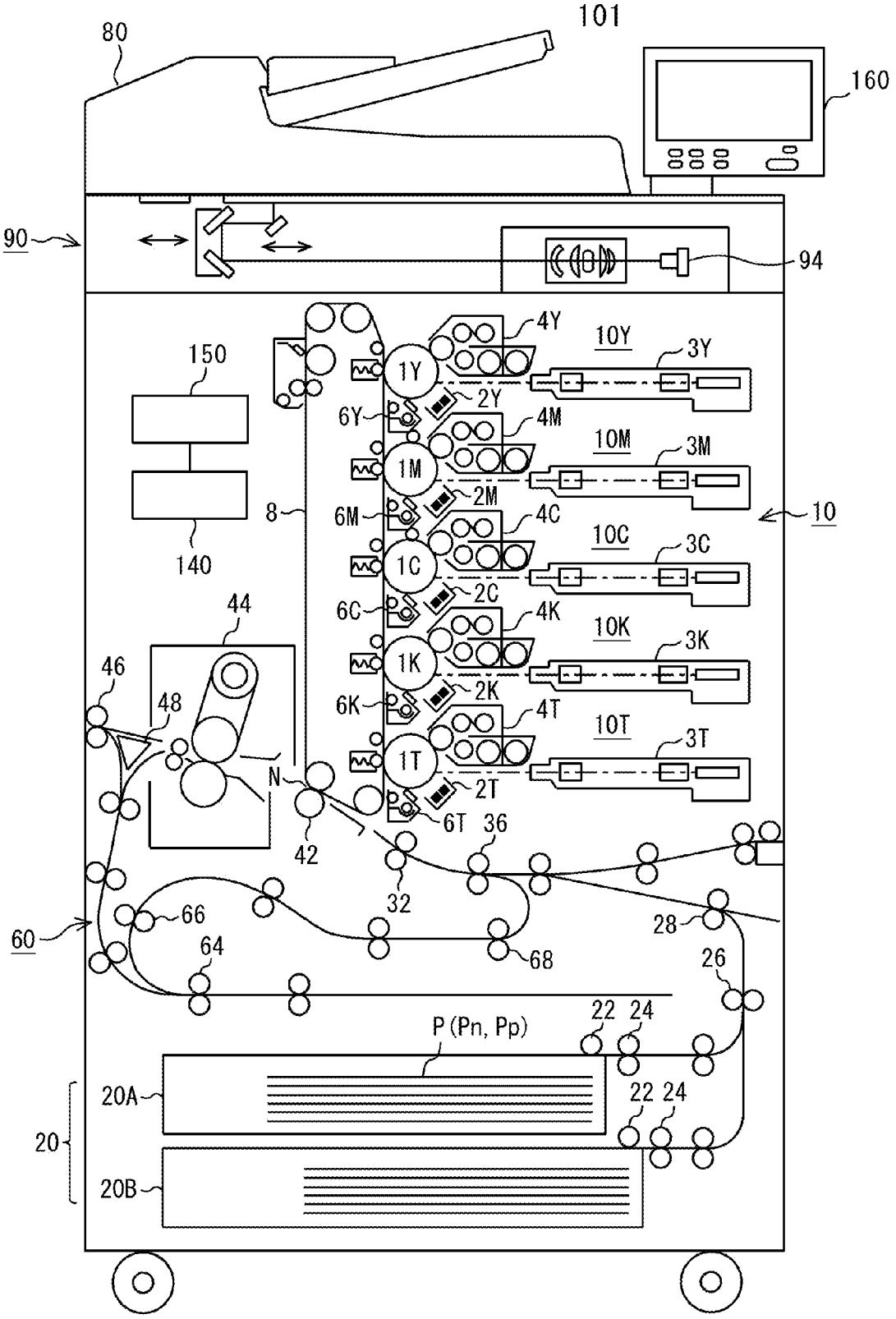
FIG. 15 is a diagram of an image forming apparatus used in an image forming system according to a third embodiment of this invention showing a configuration example thereof.

The following will describe the configuration example of the image forming apparatus 101. FIG. 15 shows the configuration example of the image forming apparatus 101 as the third embodiment according to this invention. The image forming apparatus 101 used in the image forming system according to the third embodiment of this invention may be configured so as to be identical to that of the first embodiment of this invention as shown in FIG. 3 so that the description of common components will be omitted.

An image forming unit 10T for forming a transparent image is added to the image forming portion 10, as shown in FIG. 3, used in the image forming system GS according to the first embodiment. The positional order of the image forming unit 10T is not limited to the order shown in FIG. 15.

The image forming unit 10T contains a photosensitive drum 1T, a charging portion 2T, an exposing portion 3T, a developing portion 4T and a cleaning portion 6T, which are common to other image forming units 10Y, 10M, 10C and 10K.

In this embodiment, the desired negative toner image can be formed using any of yellow, magenta, cyan, black and transparent colors. The desired negative toner image can be also formed using a combination of two colors or more.

In this embodiment, the image forming unit 10T forms the desired positive toner image using the transparent toner. The desired positive toner image is enlarged from the predetermined contour region of the specified image on which the foil transfer processing is performed. This is because an amount of estimated shift or deviation of the waste sheet of paper Pn and/or the sheet of paper and an amount of shift or deviation in the transfer position of the desired positive toner image are taken into consideration. The design is formed using any of the yellow, magenta, cyan and black colors.

[Configuration Example of Waste Sheet of Paper Pn as First Base Material]

Figure 16A:
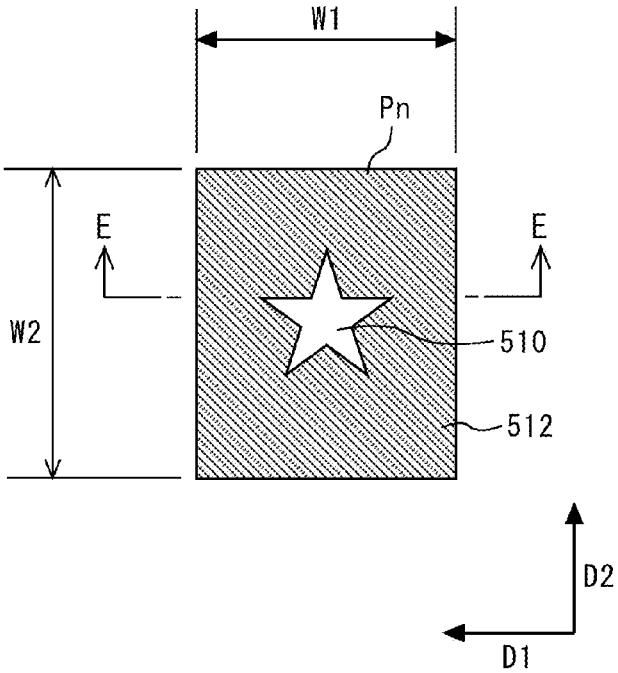
FIG. 16A is an illustration of a waste sheet of paper Pn as first base material and FIG. 16B is a sectional view thereof, taken along lines E-E.
Figure 16B:
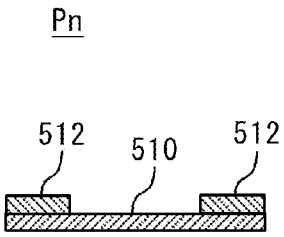

The follow will describe the configuration example of waste sheet of paper Pn used in the image forming apparatus 101 of the image forming system GS according to the third embodiment. FIG. 16A shows the configuration example of the waste sheet of paper Pn on which the desired negative toner image is transferred. FIG. 16B is a sectional view thereof, taken along lines E-E. It is to be noted that a case where the desired positive foil image to be transferred on the sheet of paper Pp is a star image will be described.

As shown in FIGS. 16A and 16B, the desired negative toner image 512 that reverses the star image is transferred on the waste sheet of paper Pn. The desired negative toner image 512 is used for adhering to the foil sheet 500 and removing from the foil sheet 500 unnecessary foil other than the desired positive foil image of star image. The recessed portion 510 on which any toner image is not transferred is formed in the desired negative toner image 512.

[Configuration Example of Sheet of Paper Pp as Second Base Material]

Figure 17A:
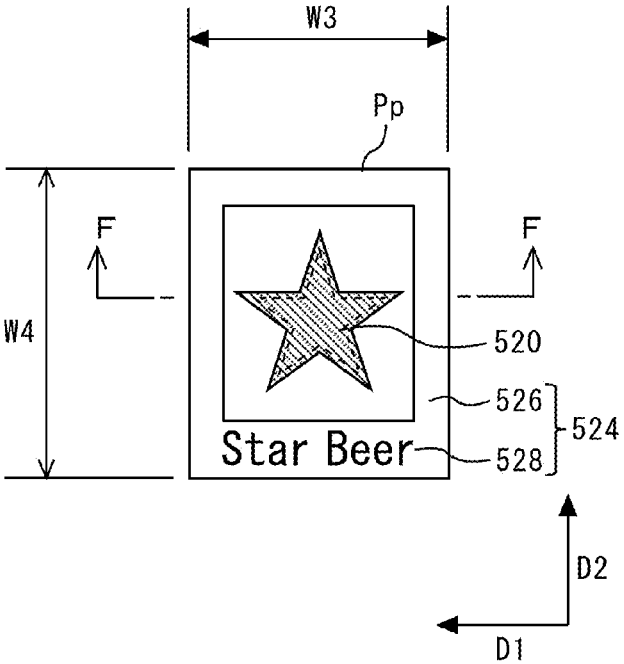
FIG. 17A is an illustration of a sheet of paper Pp as second base material and FIG. 17B is a sectional view thereof, taken along lines F-F.
Figure 17B:
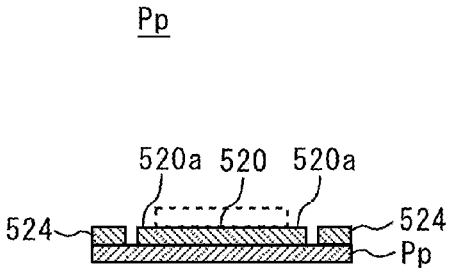
Figures 18A, 18B, 18C, 18D:
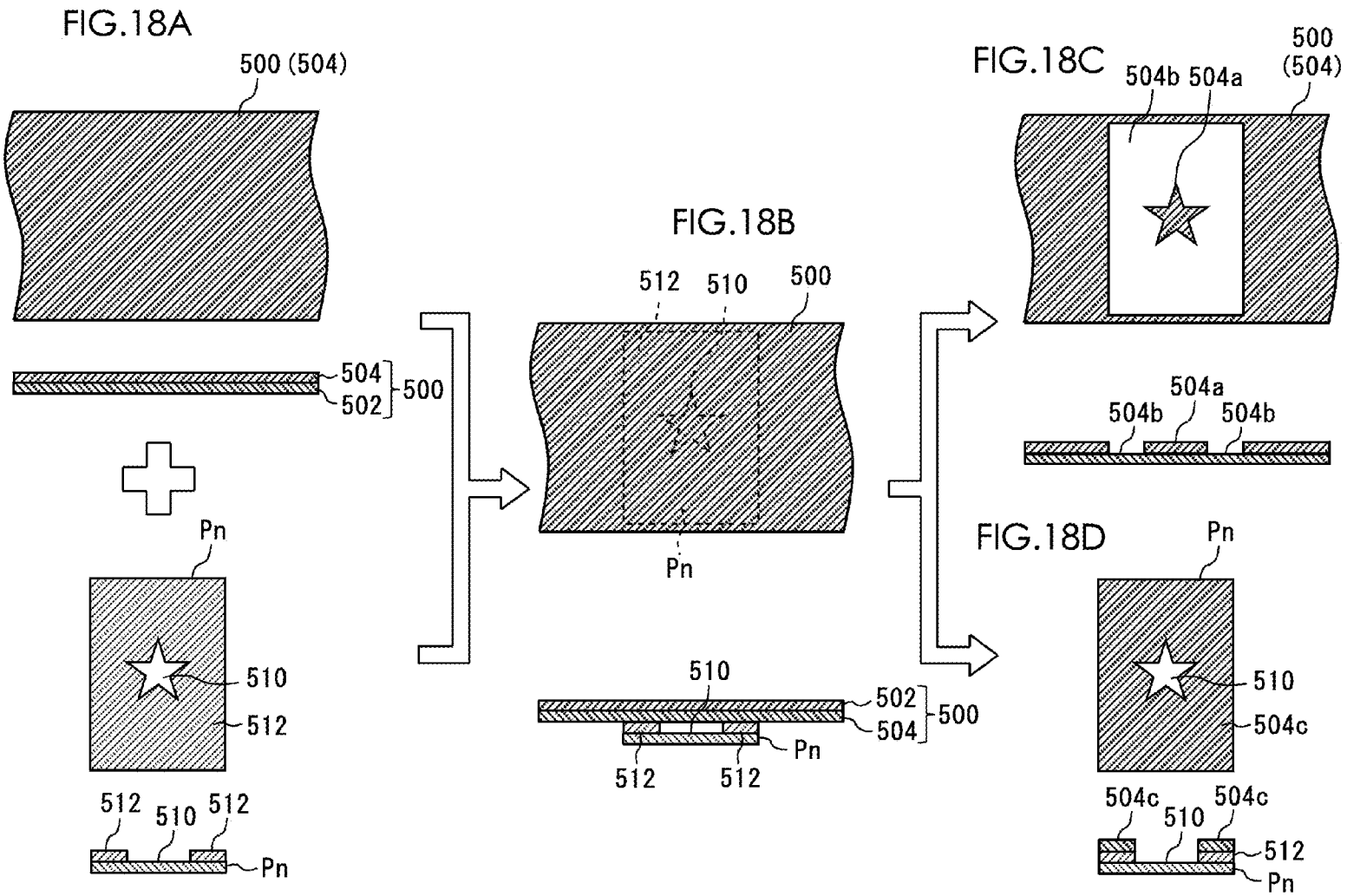
FIGS. 18A through 18D are illustrations of the foil sheet and the waste sheet of paper Pn explaining their conditions.

The following will describe the sheet of paper Pp. FIG. 17A shows the sheet of paper Pp on which all the toner images including the desired positive toner image 520 is transferred. FIG. 17B is a sectional view thereof, taken along lines F-F. It is to be noted that in the following description, a case where the desired positive foil image to be transferred to the sheet of paper Pp is a star image will be described.

As shown in FIGS. 17A and 17B, in the sheet of paper Pp, the desired positive toner image 520 of star image for transferring the desired positive foil image of star image is transferred on a middle area of the sheet of paper Pp. The desired positive toner image 520 is formed using the transparent toner. The desired positive toner image 520 has the same shape as that of the desired positive foil image (shown in the broken line in FIG. 17A) but is enlarged from this desired positive foil image by the predetermined contour region thereof (resemble shape). In the other words, the desired positive toner image 520 is transferred on the sheet of paper Pp so that the contour of the desired positive toner image 520 is enlarged from the contour of the desired positive foil image according to the amount of shift or deviation of the sheet of paper or the like. In this embodiment, an enlarged portion of the desired positive toner image 520 is referred to as "enlarged portion 520*a*". It is to be noted that the desired positive toner image 520 may be formed so as to be larger than the desired positive foil image to be transferred. Thus, it is preferable that the desired positive toner image 520 has the same shape as that of the desired positive foil image. This invention, however, is not limited to the same shape.

Further, on each edge area along each side of the sheet of paper Pp, a design 524 as the other toner image is transferred surrounding the desired positive toner image 520 of the star image. In this embodiment, the design 524 includes a frame image 526 and a character image 528, "Star Beer". An area formed between the desired positive toner image 520 and the design 524 is a recessed portion 522 on which any toner image is not transferred. It is to be noted that a width W1 of the sheet of paper Pp along the sheet-conveying direction D1 has the same length as a width W1 of the waste sheet of paper Pn along the sheet-conveying direction D1. A length W4 of the sheet of paper Pp along the direction D2 that is perpendicular to the sheet-conveying direction D1 has the same length as a length W2 of the waste sheet of paper Pn along the direction D2.

[Configuration Example of Foil Transferring Apparatus]

As the foil transferring apparatus 300 in the image forming system GS of the third embodiment according to the invention, the foil transferring apparatus 300, shown in FIG. 6, used in the image forming system GS of the first embodiment can be used, the detailed explanation of which will be omitted.

[Configuration Example of Image Forming System]

As the image forming system GS of the third embodiment according to the invention, the image forming system GS, shown in FIG. 8, used in the first embodiment can be used. The following will describe different points but an explanation of the common portions will be omitted.

The image processing portion 140 generates the desired positive image data corresponding to the foil transfer processing area and reverses the desired positive image data to generate the desired negative image data. The desired negative image data is used for forming the desired negative toner image to be transferred on the waste sheet of paper Pn. The image processing portion 140 also generates desired positive image data by changing the desired positive image data corresponding to the foil transfer processing area so as to enlarge the desired positive toner image from the desired positive foil image by the predetermined contour region thereof. The image processing portion 140 further generates the image data on all the toner images including the enlarged desired positive toner image by combining the image data on the enlarged desired positive toner image with the image data on the sheet of paper Pp excluding the foil transfer processing area. The printing image data on all the toner images is used when transferring the toner images on the sheet of paper Pp.

When the user selects the foil transfer processing mode on the manipulation/display portion 160 and inputs or selects the foil transfer processing area, to be transferred, on the manipulation screen thereof, the control portion 150 controls the image processing portion 140 to generate the desired positive image data corresponding to the input or selected foil transfer processing area and reverses the desired positive image data to generate the desired negative image data. Further, the control portion 150 controls the image processing portion 140 to generate the desired positive image data by changing the desired positive image data corresponding to the foil transfer processing area so as to enlarge the desired positive toner image from the desired positive foil image by the predetermined contour region thereof. The control portion 150 controls the image processing portion 140 to generate the image data on all the toner images including the enlarged desired positive toner image by combining the image data on the enlarged desired positive toner image with the image data on the sheet of paper Pp excluding the foil transfer processing area. The control portion 150 may calculate a scope of the contour region of the positive toner image to be enlarged automatically from the amount of shift or deviation of the sheet of used paper Pp or the amount of shift or deviation of the desired positive toner image or the like. The user may select any optional scope of the contour region of the positive toner image, to be enlarged, on the manipulation screen of the manipulation/display portion 160.

[Operation Example of Image Forming Apparatus]

The following will describe an operation example of the image forming apparatus 101 used in the image forming system GS as the third embodiment according to this invention. Since the image forming apparatus 101 operates according to the flowchart, shown in FIG. 9, of the first embodiment, the following will describe different points but an explanation of the common portions will be omitted.

At the step S104, the control portion 150 controls the image forming portion 10 to develop and transfer the desired positive toner images corresponding to the desired positive foil image on the sheet of paper Pp fed from the feeder 20. For example, when the desired positive foil image of star image is transferred on the sheet of paper Pp as shown in FIGS. 16A and 17A, the desired positive toner image 520 having the same shape as that of the desired positive foil image, to be transferred with being enlarged from the desired positive foil image by the predetermined contour region thereof is transferred on a corresponding position of the sheet of paper Pp. Specifically, for example, when estimating that an amount of the positional deviation of the sheet of paper Pp is within a range of 2 mm, the contour (outline) of the desired positive toner image 520 is enlarged from the contour of desired positive foil image by 3 mm. It is to be noted that the desired positive toner image 520 may be transferred over whole of the sheet of paper Pp in order to transfer the desired positive foil image thereon surely. This enables any edges of transparent toner to be completely removed from the desired positive toner image 520.

[Operation Example of Foil Transferring Apparatus]

Since the foil transferring apparatus 300 operates according to the flowchart, shown in FIG. 10, of the first embodiment, the following will describe different points but an explanation of the common portions will be omitted.

Figures 19A, 19B, 19C, 19D:
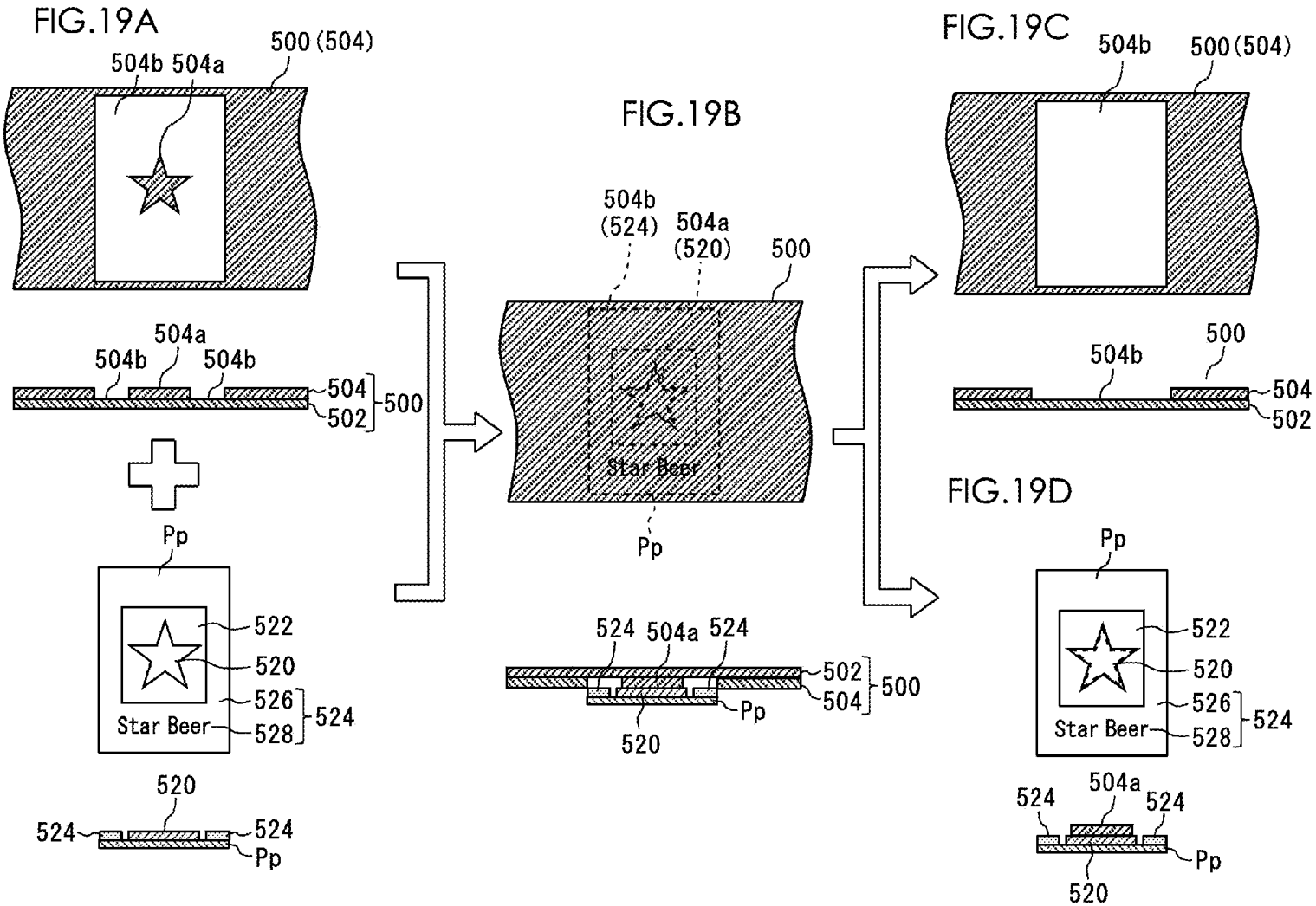
FIGS. 19A through 19D are illustrations of the foil sheet and the sheet of paper Pp explaining their conditions.
Figure 20A:
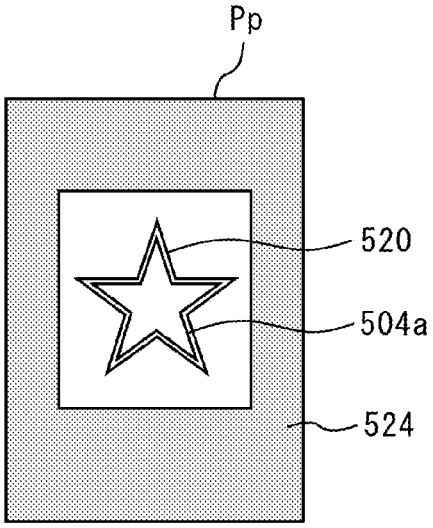
FIGS. 20A and 20B are diagrams showing an example of positional relationship between a desired positive foil image of the foil sheet from which a desired negative foil image is removed and a desired positive toner image of the sheet of paper Pp.
Figure 20B:
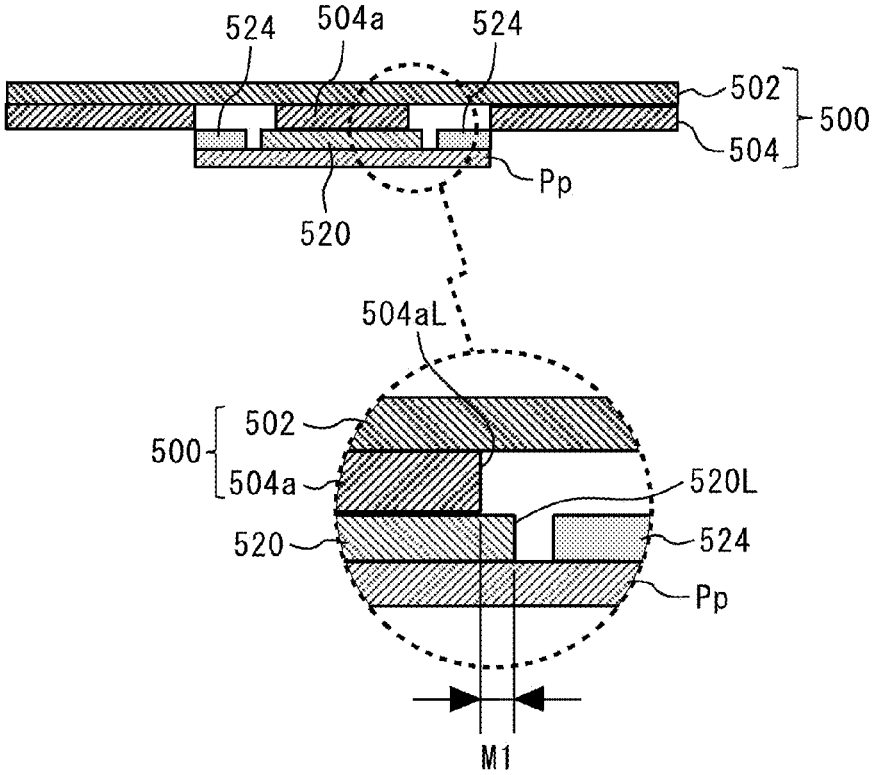

FIGS. 18A through 18D illustrate the foil sheet 500 and the waste sheet of paper Pn explaining their conditions. FIGS. 19A through 19D are illustrations of the foil sheet 500 and the sheet of paper Pp explaining their conditions. FIG. 20A enlarges FIG. 19D. FIG. 20B is a sectional view thereof. It is to be noted that in FIG. 20A, the foil sheet 500 and the sheet of paper Pp are seen from a side of the foil sheet 500 and that hatching and the like are omitted therefrom for convenience.

At the step S213, the control portion 350 controls the second thermal transferring portion 308 to lay the desired positive foil image 504 of the foil sheet 500 on top of a surface of the sheet of paper Pp, on which the desired positive toner image 520 is transferred, to heat and pressure them. Thus, the desired positive foil image is transferred on the desired positive toner image on the sheet of paper Pp. Specifically, as shown in FIGS. 19A and 19B, the second thermal transferring portion 308 lays the desired positive foil image 504 of the foil sheet 500 on top of the desired positive toner image 520 transferred on the sheet of paper Pp to heat and pressure them. In this embodiment, since the desired positive toner image 520 on the sheet of paper Pp is enlarged from the desired positive foil image 504*a* remained on the foil sheet 500 by the predetermined contour region thereof, as shown in FIGS. 20A and 20B, a margin M1 occurs between the contour 504*a*L of the desired positive foil image 504*a* and the contour 520L of the desired positive toner image 520. It is to be noted that FIGS. 20A and 20B show a case where there is no positional deviation of the sheet of paper Pp or no deviation of image positions. Accordingly, it is capable of preventing the desired positive foil image 504*a* from being broken when transferring it even if the foil sheet 500 is laid on the sheet of paper Pp and they are shifted within a region of the margin M1 or the desired positive toner image 520 is transferred on the sheet of paper Pp while they are shifted within a region of the margin M1.

Thus, as shown in FIG. 19D, only the desired positive foil image 504*a* of star image, which remains in the foil sheet 500, is transferred on the desired positive toner image 520 of the sheet of paper Pp without being broken. On the other hand, as shown in FIG. 19C, the desired positive foil image 504*a* of star image is removed from the base member 502 so that in the foil layer 504 of the foil sheet 500, the recessed portion 504*b* corresponding to the size of the waste sheet of paper Pn is formed. If the desired positive foil image 504*a* is transferred on the sheet of paper Pp, the control portion 350 goes to a step S214 of FIG. 10.

As described above, according to the image forming system GS as this third embodiment, since the desired positive toner image 520 is transferred on the sheet of paper Pp so that the desired positive toner image 520 is enlarged with taking into consideration the amount of positional deviation of the sheet of paper and/or the image positions, the deviation disappears when the positional deviation of the sheet of paper and/or the like occurs and such deviation is limited within the enlarged portion of the desired positive toner image 520. Thus, it is possible to prevent the foil image to be transferred on the sheet of paper Pp from being broken. Further, even when the enlarged portion of the desired positive toner image 520 projects from the desired positive foil image 504*a* after the desired positive foil image 504*a* is transferred, the enlarged portion of the desired positive toner image 520 becomes unremarkable because the desired positive toner image 520 is formed using the transparent toner. This enables the correct foil image to be obtained without any image degradation.

Further, according to the image forming system GS of this third embodiment, it is possible to perform the rapid foil transfer processing successively, which improves a productivity thereof. Additionally, since a universal tray such as the large capacity feeder 200 is adapted in this image forming system GS of this third embodiment, it is possible to deal with the sheets of paper with various kinds of sizes flexibly, which enables the image forming system GS which can be easier to handle to be presented.

Additionally, according to the image forming system GS of this third embodiment, since the sheet of paper Pp aligns the waste sheet of paper Pn by shifting the sheet of paper Pp by an amount of deflection of the waste sheet of paper Pn at a preceding step of conveying the sheet of paper Pp to the second thermal transferring portion 308, it is possible to transfer the desired positive foil image on a predetermined position of the sheet of paper Pp automatically with high positional accuracy and precision.

Additionally, according to the image forming system GS of this third embodiment, since both surfaces of the waste sheet of paper Pn may be used by providing with the reverse conveying path R5, numbers of the waste sheet of paper Pn disposed in the course of transferring the foil image may be automatically reduced by half without taking a lot of time.

Fourth Embodiment

The fourth embodiment is different from the third embodiment in that an enlarged toner image is used as the desired positive toner image and any gradation processing is performed on the edge (contour) of the enlarged desired positive toner image. It is to be noted that other configuration of the image forming system GS is identical to that of the above-mentioned third embodiment so that the common components are referred by the same symbols and their detailed explanation will be omitted.

[Configuration Example of Toner Image Transferred on Sheet of Paper Pp as Second Base Material]

Figure 21:
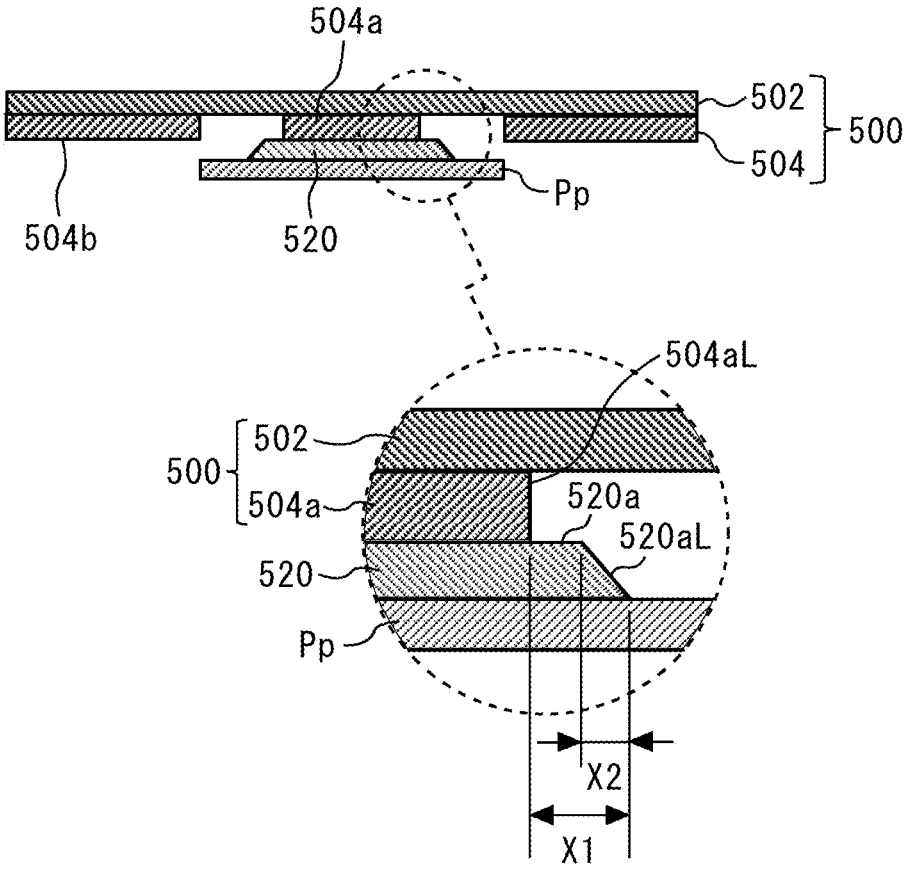
FIG. 21 is an illustration of a desired positive toner image formed on the sheet of paper Pp in a foil transferring apparatus of the image forming system according to a fourth embodiment of this invention showing a configuration example thereof.

FIG. 21 shows a situation where the sheet of paper Pp is attached to the foil sheet 500 in the image forming system GS according to the fourth embodiment of this invention. It is to be noted that other toner images such as the design are omitted from FIG. 21 for convenience. As shown in FIG. 21, the desired positive toner image 520 for fusing the desired positive foil image 504*a* and removing the desired positive foil image 504*a* from the foil sheet 500 is transferred on the sheet of paper Pp so that it is enlarged from the desired positive foil image 504*a* by the predetermined contour region. Any gradation processing is performed on the portion (enlarged portion 520*a*) of the desired positive toner image 520, which projects outward from the contour 504*a*L of the desired positive foil image 504*a*. The gradation processing is referred to as processing of gradating the contour 520*a*L of the enlarged portion 520*a* so that edge of the enlarged portion 520*a* becomes unclear. For example, the transparent toner adheres to the enlarged portion 520*a* so that an amount of the transparent toner becomes gradually smaller toward outside by regulating gradient of the transparent toner constituting the enlarged portion 520*a*. Specifically, as shown in FIG. 21, when a width X1 of the enlarged portion 520*a* is set so as to be 3 mm, any gradation is performed on the edge X2 of 1 mm of the width X1 thereof. Such gradation processing may be performed using dithering process as a known technology.

The user can determine whether or not the desired positive toner image 520 is enlarged and any gradation processing is performed using the manipulation screen of the manipulation/display portion 160. The user also can do it using the manipulation screen of computer connecting the image forming apparatus 100. In this moment, the user can set an extent of gradation processing. For example, he or she can set a range (X2) from the contour 520*a*L in the enlarged portion 520*a* of the desired positive toner image 520, on which the gradation processing is performed. When receiving instruction information relative to the gradation processing from the manipulation/display portion 160 or the like, the control portion 150 of the image forming apparatus 100 controls the image processing portion 140 to form the desired positive toner image 520 on the sheet of paper Pp based on the received instruction information so that the desired positive toner image 520 is enlarged from the desired positive foil image by the predetermined contour region thereof. At the same time, the control portion 150 controls the image processing portion 140 to perform the gradation processing on the contour 520*a*L of the enlarged portion 520*a* of the desired positive toner image 520.

As described above, according to the image forming system GS of the fourth embodiment, the gradation processing is performed on the contour 520*a*L of the enlarged portion 520*a*, which projects from the desired positive foil image, of the desired positive toner image 520 transferred on the sheet of paper Pp so that the edge of the desired positive toner image 520 becomes blur. This enables any little difference in the enlarged portion 520*a* of the desired positive toner image 520 to be difficult to be seen from outside even when there occur the positional deviation of the sheet of paper Pp and/or any transfer shifting of the desired positive toner image 520 while it is possible to prevent the desired positive foil image 504*a* from being broken when transferring the desired positive foil image 504*a*.

Although the present invention has been described with reference to the embodiments above, it is to be noted that the present invention is not limited to the embodiments, and various changes and modifications are possible to those who are skilled in the art insofar as they are within the scope of the invention. For example, although in the above-mentioned third and fourth embodiments, the whole of the desired positive toner image 520 is formed using the transparent toner, only the enlarged portion 520*a*, which projects from the desired positive foil image, of the desired positive toner image 520 transferred on the sheet of paper Pp may be formed using the transparent toner. In other words, only the portion which the user can see after the desired positive foil image is transferred thereon may be formed using the transparent toner. Although the enlarged desired positive toner image 520 has had the same shape as that of the desired positive foil image, this invention is not limited thereto: The enlarged desired positive toner image 520 may be larger than the desired positive foil image.

Although cases in which the control portion 150 of the image forming apparatus 100 mainly controls the foil transfer processing and the like together with other control portions 250 and 350 have been described in the above-mentioned first through fourth embodiment, this invention is not limited thereto: The control portion 350 of the foil transferring apparatus 300 may mainly control the foil transfer processing.

Although the control such that the sheet of paper Pp passes through the intersection Pc preferentially in comparison to the waste sheet of paper Pn have been performed in the above-mentioned first through fourth embodiment, this invention is not limited thereto: For example, the control such that the waste sheet of paper Pn passes through the intersection Pc preferentially in comparison to the sheet of paper Pp may be performed. In this case, the conveying speed of the waste sheet of paper Pn is controlled so as to be increased or decreased in order to prevent the waste sheet of paper Pn and the sheet of paper Pp from being conflicted with each other at the intersection Pc.

Although the foil images to be transferred on the sheet of paper Pp have been star images in the above-mentioned first through fourth embodiments, this invention is not limited thereto: Another image other than the star image can be adapted. Although in the above-mentioned embodiments, the driving portions 372, 374 for conveying rollers and driving portions 376, 378 for paper ejection rollers in the foil transferring apparatus 300 have been described for convenience so as to have such a configuration that plural rollers are driven at the same time, this invention is not limited thereto: Respective rollers may be separately driven.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming system which transfers a desired positive foil image on a desired positive toner image selected among all the toner images formed on second base material, the system comprising:

an image forming portion which forms, on a first base material, a desired negative toner image that reverses the desired positive toner image and forms, on the second base material, all the toner images, the toner images including the desired positive toner image;

a paper-feeding portion that feeds the first and second base materials to the image forming portion, the paper-feeding portion being positioned at an upstream side of the image forming portion;

a conveying portion which conveys a foil sheet having a foil layer on its surface, the conveying portion being positioned at a downstream side of the image forming portion;

a first transferring portion which transfers the desired negative foil image from the foil sheet on the desired negative toner image of the first base material, the first transferring portion being positioned at an upstream side of the conveying portion;

a second transferring portion which transfers the desired positive foil image on the desired positive toner image of the second base material, the second transferring portion being positioned at a downstream side of the first transferring portion on the conveying portion, the desired positive foil image being formed on the foil sheet by transferring the desired negative foil image on the first base material in the first transferring portion and removing the desired negative foil image from the foil sheet; and a control portion which controls the paper-feeding portion to feed the first base material that has a larger size than that of the second base material.

2. The image forming system according to claim 1 wherein the paper-feeding portion comprises:

plural feeding trays, on each of which the first or second base material having an optional size is set; and plural detection portions, each of which detects the size of the first or second base material to be set on each of the plural feeding trays, each detection portion being provided in each of the plural feeding trays, wherein the control portion controls the paper-feeding portion to choose between the first and second base materials based on information of the sizes of the first and second base materials, the sizes being detected by the plural detection portions, and to feed the chosen base material.

3. The image forming system according to claim 2 wherein the first base material has a size that is at least twice as large as that of the second base material, and The control portion controls the image forming portion to form plural desired negative toner images based on the size of the first base material.

4. The image forming system according to claim 2 wherein the conveying portion comprises:

a roll on which the foil sheet is wound;

a setting portion that sets the roll;

a reel portion that winds the foil sheet, the reel portion being positioned at a downstream side of the setting portion; and a driving portion that conveys the foil sheet to the reel portion.

5. The image forming system according to claim 1 wherein the control portion adjusts a position of the second base material based on a position of the first base material while the second base material is conveyed to the second transferring portion.

6. The image forming system according to claim 1 further comprising a manipulation/display portion that sets an image relating to a foil processing area in which the foil is transferred onto the image selected among all the images.

7. An image forming system which forms a desired positive foil image on a desired positive toner image of second base material, the system comprising:

an image forming portion which forms, on a first base material, a desired negative toner image that reverses positive image for transferring foil and forms, on the second base material, all the toner images, the toner images including the desired positive toner image in which the positive image is enlarged;

a paper-feeding portion that feeds the first and second base materials to the image forming portion, the paper-feeding portion being positioned at an upstream side of the image forming portion;

a conveying portion which conveys a foil sheet having a foil layer on its surface, the conveying portion being positioned at a downstream side of the image forming portion;

a first transferring portion which transfers the desired negative foil image from the foil sheet on the desired negative toner image of the first base material, the first transferring portion being positioned at an upstream side of the conveying portion;

a second transferring portion which transfers the desired positive foil image on the desired positive toner image of the second base material, the second transferring portion being positioned at a downstream side of the first transferring portion on the conveying portion, the desired positive foil image being formed on the foil sheet by transferring the desired negative foil image on the first base material in the first transferring portion and removing the desired negative foil image from the foil sheet; and a control portion which controls at least the image forming portion, wherein the control portion controls the image forming portion to form the desired positive toner image on the second base material, the desired positive toner image being enlarged more than the desired positive foil image.

8. The image forming system according to claim 7 wherein the control portion controls the image forming portion to form the desired positive toner image, to be formed on the second base material, using transparent toner.

9. The image forming system according to claim 7 wherein the control portion controls the image forming portion to perform gradation processing on an edge of the desired positive toner image.

10. The image forming system according to claim 7 wherein the control portion adjusts a position of the second base material based on a position of the first base material while the second base material is conveyed to the second transferring portion.

11. The image forming system according to claim 7 further comprising a manipulation/display portion that sets an image relating to a foil processing area in which the foil is transferred onto the image selected among all the images.

* * * * *